US005890028A

United States Patent [19]

Nomura et al.

[11] Patent Number: 5,890,028

[45] Date of Patent: Mar. 30, 1999

[54] APPARATUS FOR AND METHOD OF DEVELOPMENT PROCESSING

[75] Inventors: Hideaki Nomura; Toshio Kurokawa, both of Minami-ashigara, Japan

[73] Assignee: Fuji Photo Film Co., Ltd., Kanagawa, Japan

[21] Appl. No.: 996,296

[22] Filed: Dec. 22, 1997

[30] Foreign Application Priority Data

Dec. 20, 1996 [JP] Japan ..... 8-342071
Dec. 20, 1996 [JP] Japan ..... 8-342072

[51] Int. Cl.[6] ..... G03D 3/08; G03D 13/00

[52] U.S. Cl. ..... 396/571; 396/576; 396/626; 396/625

[58] Field of Search ..... 396/594, 595, 396/571, 576, 626, 630; 118/423, 424, 429; 355/27–29; 134/122 P

[56] References Cited

U.S. PATENT DOCUMENTS 5,809,362 9/1998 Tsuji ..... 396/576

FOREIGN PATENT DOCUMENTS 2-125255 5/1990 Japan ..... G03D 3/06
2-199452 8/1990 Japan ..... G03C 5/29
5-273719 10/1993 Japan ..... G03D 3/00
7-74895 8/1995 Japan ..... G03D 3/08
7-109503 11/1995 Japan ..... G03D 3/02
9-211829 8/1997 Japan ..... G03D 3/08
9-265173 10/1997 Japan ..... G03D 15/00
9-292688 11/1997 Japan ..... G03D 3/00

*Primary Examiner*—D. Rutledge
*Attorney, Agent, or Firm*—Sughrue, Mion, Zinn, Macpeak & Seas, PLLC

[57] ABSTRACT

A development processing apparatus includes: a plurality of stock tanks which stores a plurality of types of processing solutions; a small-volume single processing tank including an entrance/exit port for a film which enables the entering/exiting of the film, the processing tank accommodating the film via the entrance/exit port for a film and developing the film in the plurality of types of processing solutions; processing solution supply which supplies the plurality of types of processing solutions from the plurality of stock tanks to the processing tank in a predetermined order; a sensor which measures the temperature of the processing solution within the processing tank; a heater which is disposed at the stock tanks or the processing solution supply and heats the processing solution; and control which is connected to the processing solution supply and the heater and controls the processing solution supply such that the last processing solution supplied to the processing tank is filled within the processing tank even after the film is removed from the processing tank, and the control controlling the heater such that the temperature of the last processing solution is set to a predetermined temperature and that the processing tank is lagged by the last processing solution heated by the heater. Therefore, because the processing tank is lagged by the heated last processing solution upon insertion of the film, the development processing can be effected rapidly at optimal temperature.

8 Claims, 17 Drawing Sheets

APPARATUS FOR AND METHOD OF DEVELOPMENT PROCESSING

BACKGROUND OF THE INVENTION

1. Field of the Invention

The present invention relates to an apparatus for and a method of developing a film, and in particular, to an apparatus for and a method of developing a film which is suitable for small volume processing.

2. Description of the Related Art

A silver halide color photographic photosensitive material, which has been exposed, is processed by processes for color development, desilvering, washing, stabilization, and the like. Color developer is used in the color development process; bleaching solution, fixing solution, and bleach-fixing solution are used in the desilvering process; drinking water, well water, chemically or physically processed water or ion-exchange water, and distilled water are used in the washing process; and stabilizer is used in the stabilizing process. On the other hand, a black-and-white photographic photosensitive material is processed by a process for black-and-white development instead of color development, and processes for fixing and washing. The temperatures of processing solutions are normally adjusted to 20° C. to 70° C., preferably 30° C. to 60° C., and the color and black-and-white photographic photosensitive materials are immerged and processed in these processing solutions.

Recently, color photographic photosensitive materials are processed in a so-called "mini laboratory", which undergoes small volume processing of photosensitive materials, rather than in a large-scale processing laboratory, which undergoes intensive processing thereof, and a small volume of photosensitive materials are processed dispersively. Moreover, a development processing apparatus of "mini laboratory" size is not necessarily provided at a photo studio. The apparatus can be provided at various types of stores such as a bookstore, a gas station, a laundry, a supermarket, a convenience store, and the like. It is certainly preferable that the surface area of development processing apparatus provided at these stores is small. Further, it is increasingly necessary that the apparatus operates stably and does not require maintenance even if a small volume of photosensitive materials are processed.

As the above-described development processing apparatus, Japanese Patent Application Publication No. 7-109503, Japanese Patent Application Publication No. 7-74895, Japanese Patent Application Laid-Open (hereinafter, "JP-A") No. 2-125255, JP-A No. 2-199452 disclose a technology in which a processing tank is designed in a slit-shape and the volume of the tank is made small. Further, JP-A No. 9-292688 discloses a simple and small-volume development processing apparatus.

In a case in which the processing tank is designed in a slit-shape as described above, a processing solution storing portion becomes extremely narrow. Accordingly, it is extremely complicated and difficult to provide heating means at the processing tank. Further, the development processing apparatus is expected to be rarely used and very inactive in a store such as a convenience store in which the apparatus needs to be on standby for a long time (e.g., 24 hours). Moreover, when the development processing apparatus is provided at an entrance or the like and the entrance is opened so as to allow the entering of cold air (cold outside air), the temperature within the processing tank is lowered rapidly due to its small volume.

In the above-described development processing apparatus, when a film is inserted into the processing tank, it is confirmed that the probability of occurring of conveyance deficiency is increased under the condition in which the interior of processing tank is highly humid. It is considered that the deficiency is caused by the fact in which the film does not slide smoothly against the inner walls of the processing tank (e.g., the film adheres to the inner walls to which water such as water droplet adheres).

In order to solve this problem, drawing means for drawing a film into a processing tank may be provided, or a material of inner walls of processing tank may be changed to a material which improves the sliding of a film (e.g., from vinyl chloride to Teflon (trade name for polytetrafluoroethylene manufactured by Du Pont K.K.)). However, it is not preferable since the amount of processing solutions to be used and the cost of processing apparatus are increased.

Also, the interior of processing tank may be dried completely. However, it is difficult and expensive to dry quickly and reliably the sheath-shaped processing tank which has one narrow entrance/exit port for a film.

SUMMARY OF THE INVENTION

Accordingly, an object of the present invention is to solve the above drawback, i.e., to provide an apparatus for and a method of development processing in which a film is developed rapidly in processing solution at optimal temperature.

Further, another object of the present invention is to provide an apparatus for and a method of development processing which is simple and in which a film is conveyed to a processing tank easily and reliably.

A first aspect of the present invention is a development processing apparatus comprising: a plurality of stock tanks which stores a plurality of types of processing solutions; a small-volume single processing tank including an entrance/exit port for an elongated film which enables the entering/exiting of the film, the processing tank accommodating the film via the entrance/exit port for a film and developing the film in the plurality of types of processing solutions; processing solution supply means which supplies the plurality of types of processing solutions from said plurality of stock tanks to said processing tank in a predetermined order; a sensor which measures the temperature of the processing solution within said processing tank; a heater which is disposed at one of said stock tanks and said processing solution supply means and heats the processing solution; and control means which is connected to said processing solution supply means and said heater and controls said processing solution supply means such that the last processing solution supplied to said processing tank is filled within said processing tank even after the film is removed from said processing tank, and said control means controlling said heater such that the temperature of the last processing solution is set to a predetermined temperature and that said processing tank is lagged by the last processing solution heated by said heater.

In the development processing apparatus in the first aspect of the present invention, firstly, the processing tank is filled with the heated last processing solution by the processing solution supply means before the film is inserted. The film is inserted into the processing tank through the film insertion opening. Thereafter, a plurality of types of processing solutions is supplied from the stock tanks to the processing tank in that order and the film is developed within the processing tank. Namely, in accordance with the development processing apparatus of the first aspect, because the processing tank is lagged by the heated last processing solution upon insertion of the film, the film can be developed rapidly at optimal temperature.

A small-volume single processing tank used in the present invention is a portion which corresponds to a processing tank portion of the film. The small volume means that the volume of the processing tank portion is sufficiently small, i.e., preferably 10 ml to 500 ml, and more preferably 20 ml to 300 ml. The volume of the processing tank portion used herein means the volume of solution only at the inner portion of the tank in which the film is processed and does not include the volume of solution in a piping system for conveying and circulating the solution.

Further, the single processing tank means that there is only one processing tank when the film is processed and the processing solution is supplied to and changed at the processing tank as occasion demands. In order to increase the processing capacity per unit of time, it is considered in the present invention that a plurality of such single processing tanks is prepared and that a plurality of films is processed simultaneously.

Concrete examples of a small-volume single sheath-shaped processing tank used in the present invention include a gap-shaped processing tank described in FIGS. 5 through 8 in JP-A No. 4-230745, a slit-shaped processing tank described in FIG. 2 in JP-A No. 7-56281, a sheath-shaped processing tank described in FIGS. 9, 15, 16 in JP-A No. 9-292688, and the like. Above all, the gap-shaped processing tank and the sheath-shaped processing tank are preferable in the present invention. Further, the sheath-shaped processing tank is particularly preferable in the present invention.

The processing tank of the present invention is connected to the plurality of small-volume processing tanks through the processing solution supply means (formed by piping, pumps, solenoid valves, and the like). The processing solution supply means is used for supplying the processing solution from the stock tanks to the processing tank at the time of processing, and for returning the processing solution from the processing tanks to the stock tank when the time required for processing is completed.

The present invention has a temperature control function for invariably maintaining the temperature of the processing solution to a target temperature. Namely, the present invention has a heater, a temperature sensor (a thermistor), a circulating function, and the like such that the temperature is controlled within ±1° C. of the target temperature, preferably within ±0.5° C. thereof, and more preferably within ±0.1° C. thereof. Further, various types of heaters on the market can be used for the heater. Concrete examples include a stainless heater in which nichrome wires are embedded by an insulator, a ceramic heater which uses the heat generated by ceramic, a surface-shaped heater which uses the heat generated by carbon fibers, a casting heater (a volume-type heater described in a method of heating the processing solution by casting the heater with a pipe which conveys temperature controlled solution in JP-A No. 5-80479 and JP-A No. 5-204117), and the like. However, the present invention is not limited to these.

As a preferable aspect, the processing tank is sheath-shaped, and a film insertion opening which enables the entering/exiting of a film may be formed only at the longitudinal direction one end of the processing tank. Further, as a preferable aspect, the cross-sectional configuration of the inner space of the processing tank is substantially circular and the film may be accommodated in a spiral-shape.

The development processing apparatus of the present invention can be used for the processing of various types of photosensitive materials. Above all, the apparatus is preferably used for the processing of photographic photosensitive materials, and more specifically, for the processing of color negative films, color reversal films, and black-and-white films.

Various types of processing solutions are used in the development processing apparatus of the present invention.

Color developer tank solution or color developer replenisher used in the development processing of color negative films is alkaline aqueous solution in which aromatic primary amine base color developing agent is a principal component. As the color developing agent, aminophenol base compound is useful, and more preferably p-phenylenediamine base compound is used. Typical examples include 3-methyl-4-amino-N,N diethylaniline, 3-methyl-4-amino-N-ethyl-N-β-hydroxyethylaniline, 3-methyl-4-amino-N-ethyl-N-β-methanesulfonamideethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxypropyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, and sulfate, hydrochloride, or p-toluenesulfonate of these anilines. Among them, 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and hydrochloride, p-toluenesulfonate, or sulfate of these are particularly preferable. Two or more types of these compounds can be combined for the purpose of application.

The amount of aromatic primary amine developing agent to be used is preferably 0.0002 mol to 0.2 mol and more preferably 0.001 mol to 0.1 mol per 1 liter of color developer.

In general, the color developer includes pH buffer such as carbonate, borate, phosphate 5-sulphosalicylate of alkaline metal, and development inhibitor or antifoggant such as chloride salt, bromide salt, iodide salt, benzimidazole group, benzothiazole group and mercapto compound. Further, as occasion demands, the color developer includes: various types of preservatives such as hydroxycylamine group represented by general formula (I) in JP-A No. 3-144446 in addition to hydroxycylamine, diethylhidroxycylamine, sulfite, hydrazine group such as N,N-biscarboxymethylhydrazine, phenylsemicarbazide group, triethanolamine, and catecholsulfonic acid group; organic solvent such as ethyleneglycol and diethyleneglycol; development accelerator such as benzilalcohol, polyethyleneglycol, quaternary ammonium salt, and amine group; color forming coupler; competing coupler; auxiliary developing agent such as 1-phenyl-3-pyrazolidone; viscosity applying agent; various types of chelating agents such as aminopolycarbonate, aminopolyphosphonate, alkylphosphonate, phosphonocarbonate; and various types of compounding agents such as ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphone acid, nitrilo-N,N,N-trimethylenephosphone acid, ethylenediamine-N,N,N,N-tetramethylenephosphone acid, ethylenediamine-di(o-hydroxyphenylacetic acid) and the salt thereof.

Among the above-described agents, non-substituted hydroxycylamine or substituted hydroxycylamine is most preferable as preservatives, and diethylhydroxycylamine, monomethylhydroxycylamine, or amine having alkyl group which is substituted by aqueous group such as sulfo group, carboxy group, and hydroxyl group is particularly preferable. The most preferable example is N,N-bis(2-sulfoethyl) hydroxylamine and the alkaline metallic salt thereof.

Further, a compound having biodegradability is preferable as a chelating agent. Examples include chelating agents described in JP-A No. 63-146998, JP-A No. 63-199295, JP-A No. 63-267750, JP-A No. 63-267751, JP-A No. 2-229146, JP-A No. 3-186841, German Patent Application No. 3,739,610, and EP-A No. 468,325.

It is preferable that processing solution in a replenishing tank for color developer is shielded by solution such as an organic solvent having high boiling point and that the surface area of the solution which contacts air is reduced. Liquid paraffin is the most preferable as the liquid sealing solution.

The processing temperature in the color developer is 20° to 55° C., preferably 30° to 55° C. The processing time is 30 seconds to 4 minutes, preferably 45 seconds to 3 minutes 20 seconds. The most preferable processing time is 60 seconds to 120 seconds.

In this processing method, the photosensitive materials are color developed, and thereafter, desilvered. In the process for desilvering, it is preferable that the photosensitive materials are processed in a common tank solution and a common replenisher. However, the amount of replenishment can be set differently in accordance with each of the photosensitive materials. Desilvering process will be explained in detail hereinafter.

In general, the desilvering process includes a bleaching process, a bleach-fixing process, a fixing process, and various other types of processes. The specific processes will be described hereinafter, however, the present invention is not limited to the same.

| | |
|---|---|
| (Process 1) | bleach—fix |
| (Process 2) | bleach—bleach-fix |
| (Process 3) | bleach—bleach-fix—fix |
| (Process 4) | fix—bleach-fix |
| (Process 5) | bleach—fix |

The respective processing baths described above may be divided into two or more, as occasion demands. The baths may be replenished in accordance with a cascade method.

Aminopolycarbonate iron (III) complex, persulfate, bromate, hydrogen peroxide, red prussiate (of potash) (or potassium ferricyanide), and the like are used as bleach used for processing solution having bleaching ability. Most preferably, aminopolycarbonate (III) complex is used.

Ferric complex salt used in the processing method may be added and dissolved as iron complex salt in which complex is formed in advance. Moreover, a complex forming compound and ferric salt (e.g., ferric sulfate, ferric chloride, ferric bromide, iron nitrate (III), iron sulfate (III) ammonium, and the like) may be mixed together so as to form complex salt in the solution having bleaching ability.

The amount of complex forming compound may somewhat exceed the amount thereof required for forming complex with ferric ion. It is preferable that the amount of complex forming compound added to excess is usually within the range of 0.01 to 10%.

A compound which forms ferric complex salt in the solution having bleaching ability includes ethylenediaminetetraacetate (EDTA), 1,3-propanediaminetetraacetate (1,3-PDTA), diethylenetriaminepentaacetate, 1,2-cyclohexanediaminetetraacetate, iminodiacetate, methyliminodiacetate, N-(2-acetoamido)iminodiacetate, nitrilotriacetate, N-(2-carboxyethyl)iminodiacetate, N-(2-carboxymethyl)iminodipropionate, β-alaninediacetate, α-methyl-nitrilotriacetate, 1,4-diaminobutanetetraacetate, glycoletherdiaminetetraacetate, N-(2-carboxyphenyl) iminodiacetate, ethylenediamine-N-(2-carboxyphenyl)-N, N', N'-triacetate, ethylenediamine-N,N'-disuccinate, 1,3-diaminopropane-N, N'-disuccinate, ethylenediamine-N,N'-dimalonate, 1,3-diaminopropane-N,N-dimalonate, and the like. However, the present invention is not limited to these.

The appropriate concentration of ferric complex salt in the processing solution having bleaching ability is 0.005 to 1.0 mol/liter, preferably 0.01 to 0.50 mol/liter, and more preferably 0.02 to 0.30 mol/liter.

The concentration of ferric complex salt in the replenisher of the processing solution having bleaching ability is preferably 0.005 to 2 mol/liter, more preferably 0.01 to 1.0 mol/liter.

Various types of compounds can be used as bleach accelerator in the baths having bleaching abilities or the previous baths thereof. For example, a compound having mercapto group or disulfide bonding described in U.S. Pat. No. 3,893,858, German Patent Application No. 1,290,812, JP-A No. 53-95630, Research Disclosure No. 17129 (July, 1978) or a thiourea base compound or a halogenated compound such as iodine, bromine ion or the like described in Japanese Patent Application Publication No. 45-8506, JP-A No. 52-20832, JP-A No. 53-32735, U.S. Pat. No. 3,706,561 and the like are preferable due to the excellent bleaching ability.

In addition, the bath having bleaching ability can include rehalogenated agent such as bromide (e.g., potassium bromide, sodium bromide, ammonium bromide), chloride (e.g., potassium chloride, sodium chloride, ammonium chloride), iodide (e.g., iodide ammonium), and the like. As occasion demands, the bath can include one or more type of organic acid or inorganic acid having pH buffer capacity such as borax, sodium metaborate, acetic acid, sodium acetate, sodium carbonate, potassium carbonate, phosphorous acid, phosphoric acid, sodium phosphate, citric acid, sodium citrate, tartaric acid, malonic acid, succinic acid, glutaric acid, and the like, and alkaline metals thereof or corrosion inhibitor such as ammonium salt, ammonium nitrate, guanidine and the like.

Furthermore, the bath having bleaching ability can include various types of optical whitening agent, antifoaming agent, surface active agent, and organic solvent such as polyvinylpyrrolidone, methanol, and the like.

It is preferable that thiosulfate is used as the fixing agent component in the bleach-fixing solution or the fixing solution. Thiosulfate can include sodium thiosulfate, potassium thiosulfate, ammonium thiosulfate, and the like. The other known fixing agent can include thiocyanic acid such as sodium thiocyanate, ammonium thiocyanate, and the like; thioether compound such as ethylenebisthioglycolic acid, 3,6-dithia-1,8-octanediol, and the like; a mesoionic compound; aqueous halogenated silver solubilizing agent such as thiourea group and the like. In the present invention, thiosulfate, especially, ammonium thiosulfate salt, potassium thiosulfate salt, and sodium thiosulfate salt are preferably used. The overall amount of fixing agent is preferably 0.3 to 3 mol/liter, more preferably 0.5 to 2.0 mol/liter.

It is preferable that sulfite (bisulfite or metabisulfite group) is included as preservatives in the bleach-fixing solution or the fixing solution. Above all, the amount of sulfite is preferably 0.03 to 0.5 mol/liter, more preferably 0.05 to 0.3 mol/liter.

The bleach-fixing solution or fixing solution includes as preservatives a sulfurous ion discharging compound such as the aforementioned sulfite (e.g., sodium sulfite, potassium sulfite, ammonium sulfite), bisulfite (e.g., ammonium bisulfite, sodium bisulfite, potassium bisulfite), metabisulfite (e.g., potassium metabisulfite, sodium metabisulfite, ammonium metabisulfite), and the like. In addition, aldehyde group (benzaldehyde, acetaldehyde, and the like), ketone group (acetone and the like), ascorbate group, hydroxylamine group, benzenesulfinic acid group, alkylsulfinic acid group, and the like can be added as occasion demands. In particular, benzenesulfinic acid, p-methylbenzenesulfinic acid, p-aminobenzensulfinic acid, and the like can be preferably used. The preferable amount to be added is about 0.005 to 0.3 mol/liter.

Moreover, buffer agent, optical whitening agent, chelating agent, antifoaming agent, anti-fungal agent, and the like can be added to the bleaching solution, bleach-fixing solution, and the fixing solution.

The pH area in the bleaching solution, the bleach-fixing solution, and the fixing solution is preferably 4 to 8, and more preferably 4.5 to 6.5.

The amount of replenishment to the bleaching solution, bleach-fixing solution, and the fixing solution is 50 to 2000 ml per 1 $m^2$ of photosensitive material. Further, the overflow solution of washing water or stabilization bath serving as posterior bath may be replenished as occasion demands.

The processing temperature of bleaching solution, bleach-fixing solution, fixing solution is 20° to 50° C., preferably 30° to 45° C. The processing time of each process is 10 seconds to 3 minutes, preferably 20 seconds to 2 minutes.

At the time of processing, it is particularly preferable that the processing solution having bleaching capacity undergoes aeration in order to maintain the photographic performance extremely stably. Means which is well-known in the industry can be used for aeration such that air is blown into the processing solution having bleaching capacity and absorbed by using an ejector.

Aeration may be effected directly in the processing tank. However, since the volume of a tank in the development processing apparatus of the present invention is small, it is preferable to effect aeration within the stock tank.

When the air is blown in, it is preferable that air is discharged into the solution through an air diffusing tube having fine pores. Such air diffusing tube is widely used for an aeration tank or the like in an activated sludge process. The process described in "Z-121, Using Process C-41" published by Eastman Kodak Co., Vol. 3 (1982), pp. BL-1 to BL-2 can be used for aeration. In the process using processing solution having bleaching capacity of the present invention, it is preferable to reinforce stirring. The process described in JP-A No. 3-33847, p. 8, upper right column, 1.6 to P.8, lower left column, 1.2 can be used as it is.

In the development processing apparatus of the present invention, it is preferable that the aeration is effected in a circulating system, stock tank or the like.

In general, the photosensitive materials undergo desilvering process, and thereafter, washing and/or stabilization process. In the washing and/or stabilization process, it is necessary that the concentration of the remaining thiosulfuric acid of the processed photosensitive materials is adjusted to 30 to 1500 micromol/$m^2$.

More specifically, it is preferable that the concentration of thiosulphate in the last bath is adjusted to about 0.001 to 0.04 mol/liter. Namely, thiosulphate having the above-described concentration may be added to the last bath. When thiosulphate is used as a fixing component, it is desirable that the amount of replenishment for the subsequent washing or stabilization process is reduced and that the concentration of the last bath is adjusted to the above-described concentration.

The specific amount of replenishment is different in accordance with the concentration of thiosulphate in the fixing process, the number of baths in the washing or stabilization process, and the like. However, the amount of replenishment is substantially 100 to 1000 ml, preferably 130 to 700 ml, per 1 $m^2$ of photosensitive material.

Further, regarding the amount of washing water in the washing process, the relationship between the number of washing tanks and the amount of water in a multistage counter flow method can be determined by the method described in Journal of the Society of Motion Picture and Television Engineers, Vol. 64, pp. 248–253 (May, 1955). In accordance with the multistage counter flow method described in the above reference, the amount of washing water can be substantially reduced. However, due to the increase in the residence time of water within the tank, bacteria is propagated, and a drawback arises in that the generated suspended matter adheres to the photosensitive material and the like.

A method of reducing calcium ion and magnesium ion described in JP-A No. 62-288,838 can be effectively used for solving such problem in the processing of color photosensitive material. Further, chlorinated bactericide such as isothiazolon compound, thiabendazole group, chlorinated sodium isocyanuric acid, and the like described in JP-A No. 57-8,542 or the other bactericide such as benzotriazole and the like described in H. Horiguchi, "Chemistory of Bactericide and Fungicide", Sankyo Shuppan (1986), "Sterlization, Bactericide, and Fungicide Technology of Microorganism", Society of Sanitary Engineers (1982), "Dictionary of Bactericide and Fungicide", Society of Industrial Engineers and The Society for Antibacterial and Antifungal Agents, Japan (1986).

The pH in the last bath can be set to any value at the time of processing the photosensitive material. The pH is preferably 3.5 to 8, more preferably 4 to 7. It is preferable that the above-described pH is set so as to reflect the membrane pH of the processed photosensitive material, and various types of buffer agents can be used for that purpose. More specifically, the agents include acetic acid, malonic acid, succinic acid, malic acid, maleic acid, phthalic acid, and the like.

Further, the washing temperature and time can be set in accordance with characteristics, application, and the like of photosensitive material. In general, the washing temperature and time is selected from within the range of 20° to 45° C. and 20 seconds to 5 minutes, preferably 25° to 40° C. and 30 seconds to 3 minutes. Further, the photosensitive material of the present invention can be processed directly in the stabilizer instead of the above washing water. In such stabilization processing, all of the well-known methods described in JP-A No. 57-8543, JP-A No. 58-14834, JP-A No. 60-220345 can be used.

Further, the stabilizer includes a compound stabilizing a color image such as formalin; benzaldehyde group such as m-hydroxybenzaldehyde; formaldehyde bisulphite adduct; hexamethylenetetramine and the derivative thereof; hexahydrotriazine and the derivative thereof; dimethylolurea; N-methylol compound such as N-methylolpyrazole; organic acid; pH buffer agent, and the like. The preferable amount of addition of these compounds is 0.001 to 0.02 mol per 1 liter. Because less formaldehyde gas flies, it is preferable that the concentration of free formaldehyde in the stabilizer is low. From this point, it is preferable that the color image stabilizer to be used is m-hydroxybenzaldehyde, hexamethylenetetramine, N-methylolpyrazole group such as N-methylolpiazole and the like described in JP-A No. 4-270344, azolilemethylamine such as N,N'-bis(1,2,4-triazole-1-ilmethyl)piperazine and the like described in JP-A No. 4-313753. In particular, the combination of azole group such as 1,2,4-triazole described in JP-A No. 4-359249 (corresponding to EP-A No. 519190A2) and azolilemethylamine and the derivative thereof such as 1,4-bis(1,2,4-triazole-1-ilmethyl)piperazine is preferable in that the image stability is high and the vapor pressure of formaldehyde is less. Further, as occasion demands, it is preferable to include an ammonium compound such as ammonium chloride, ammonium sulfite, and the like; a metal compound such as Bi, Al, and the like; optical whitening agent; hardener; alkanoleamine described in U.S. Pat. No. 4,786,583; and preservatives which can be included in the fixing solution or bleach-fixing solution, e.g., sulfinic acid compound described in JP-A No. 1-231051.

In order to prevent irregularities in droplets when the processed photosensitive materials are dried, the washing water and/or stabilizer can include various surface active agents. Among them, nonionic surface active agent is the most preferable, and in particular, alkylphenolethylene oxide adduct is preferable. As alkylphenol, octyl, nonyl, dodecyl, dinonylphenol are particularly preferable, and the additional mol number of ethylene oxide is preferably 8 to 14. Additionally, it is preferable to use a silicon base surface active agent having high antifoaming effect.

It is preferable that various types of cheleating agents are included in the washing water and/or stabilizer. Preferable cheleating agents include aminopolycarbonic acid such as ethylenediaminetetraacetate, diethylenetriaminepentaacetate, and the like; an organic phosphonic acid such as 1-hydroxyethylidene-1,1-diphosphonic acid, N,N,N'-trimethylenephosphonic acid, die thylenetriamine-N,N,N'-tetramethylenephosphonic acide; or hydrolysate of maleic anhydride polymer described in EP-A 345,172A1.

A second aspect of the present invention is a development processing apparatus according to the first aspect, further comprising: a sealing device which closes the entrance/exit port for a film.

In the second aspect, the entrance/exit port for a film is closed by the sealing device so as to prevent heat dissipation from the entrance/exit port for a film.

A third aspect of the present invention is a development processing apparatus according to the first aspect, further comprising: conveying means which, in a state in which the longitudinal direction one end of the elongated film is engaged with a spool shaft and in which the film is taken up onto the spool shaft from the longitudinal direction one end of the film, conveys the film out of a film container accommodating the film from the longitudinal direction other end of the film and maintains a state in which the longitudinal direction one end of the film is engaged with the spool shaft, wherein the longitudinal direction length of said processing tank is longer than the longitudinal direction length of a portion of the film which is processed in the processing solution, said processing tank is sheath-shaped and the entrance/exit port for a film is formed only at the longitudinal direction one end of said processing tank.

At the development processing apparatus in the above-described third aspect, for example, the processing tank is filled with the processing solution by the processing solution supply means before the film is inserted. The film is conveyed out of the film container by the conveying means in a state in which the longitudinal direction end of the film is engaged with the spool shaft. The film conveyed out of the film container is inserted into the processing tank, which has been filled with the processing solution beforehand, through the film insertion opening. Thereafter, the film is developed in the processing solution supplied by the processing solution supply means.

Namely, in accordance with the development processing apparatus of the third aspect, because the processing tank is previously filled with the processing solution before the film is inserted and the film is inserted in this state, the film will not attach and adhere to the inner walls of the processing tank even if the film interferes with (abuts) the inner walls upon insertion of the film. Thus, the conveyance deficiency at the time of insertion of the film into the processing tank is prevented. Therefore, in accordance with the development processing apparatus of the third aspect, there is no need to provide drawing means for drawing the film into the processing tank and to change a material of the inner walls of the processing tank into the material which improves the sliding of the film. The film can be conveyed easily and reliably into the processing tank by the apparatus having a simple structure.

Further, in the third aspect, because the processing tank is sheath-shaped, the amount of processing solution is reduced, and the processing tank and the entire apparatus can be made even more compact.

The film container used herein includes, for example, an APS film container (cartridge) and a separate film container (including an intermediate magazine to which an intermediate spool shaft is attached) which takes up a 135-size negative film accommodated within the cartridge.

A forth aspect is a development processing apparatus according to the second aspect, further comprising: conveying means which, in a state in which the longitudinal direction one end of the elongated film is engaged with a spool shaft and in which the film is taken up onto the spool shaft from the longitudinal direction one end of the film, conveys the film out of a film container accommodating the film from the longitudinal direction other end of the film and maintains a state in which the longitudinal direction one end of the film is engaged with the spool shaft, wherein the longitudinal direction length of said processing tank is longer than the longitudinal direction length of a portion of the film which is processed in the processing solution, said processing tank is sheath-shaped and the entrance/exit port for a film is formed only at the longitudinal direction one end of said processing tank.

In the fourth aspect, because the processing tank is sheath-shaped, the amount of processing solution is reduced, and the processing tank and the entire apparatus can be made even more compact.

A fifth aspect is a development processing method used in a development processing apparatus which has: a plurality of stock tanks which stores a plurality of types of processing solutions; a small-volume single processing tank including an entrance/exit port for an elongated film which enables the entering/exiting of the film and which accommodates the film via the entrance/exit port for a film; processing solution supply means which supplies the plurality of types of processing solutions from said stock tanks to said processing tank; a sensor which measures the temperature of the processing solution within said processing tank; a heater which is disposed at one of said stock tanks and said processing solution supply means and heats the processing solution; and control means which connects said processing solution supply means and said heater, and said method comprising the steps of: supplying the plurality of types of processing solutions from said stock tanks to said processing tank in a predetermined order; developing the film in said processing tank; controlling said processing solution supply means by said control means such that the last processing solution supplied to said processing tank is filled within said processing tank even after the film is removed from said processing tank; and controlling said heater by said control means such that the temperature of the last processing solution is set to a predetermined temperature and that said processing tank is lagged by the heated last processing solution.

In the development processing method of the fifth aspect, a plurality of types of processing solutions are supplied from the stock tanks to the processing tank in a predetermined order. The heated last processing solution is filled in the processing tank before the film is inserted. The processing tank is lagged by the heated last processing solution.

A sixth aspect is a development processing method according to the fifth aspect, wherein the development processing apparatus has a sealing device which closes the entrance/exit port for a film, and in a state in which the entrance/exit port for a film is closed by said sealing device, the last processing solution is circulated by said processing solution supply means.

In the sixth aspect, the last processing solution is circulated by the processing solution supply means in a state in which the film insertion opening is closed by the sealing device such that the processing tank is lagged. Accordingly, the temperature of the interior of the processing tank can be made constant. The closed circuit may be provided at the processing tank for circulating the processing solution therewithin. Alternatively, the stock tanks and the processing tank may be combined for circulating the solution therewithin.

A seventh aspect is a development processing method according to the fifth aspect, wherein the development processing apparatus has conveying means which, in a state in which the longitudinal direction one end of the elongated film is engaged with a spool shaft and in which the film is taken up onto the spool shaft from the longitudinal direction one end of the film, conveys the film out of a film container accommodating the film from the longitudinal direction other end of the film and maintains a state in which the longitudinal direction one end of the film is engaged with the spool shaft, and the longitudinal direction length of said processing tank is longer than the longitudinal direction length of a portion of the film which is processed in the processing solution, said processing tank is sheath-shaped and the entrance/exit port for a film is formed only at the longitudinal direction one end of said processing tank.

In the seventh aspect, because the processing tank is sheath-shaped, the amount of processing solution is reduced, and the processing tank and the entire apparatus can be made even more compact.

An eighth aspect of the present invention is a development processing method according to the sixth aspect, wherein the development processing apparatus has conveying means which, in a state in which the longitudinal direction one end of the elongated film is engaged with a spool shaft and in which the film is taken up onto the spool shaft from the longitudinal direction one end of the film, conveys the film out of a film container accommodating the film from the longitudinal direction other end of the film and maintains a state in which the longitudinal direction one end of the film is engaged with the spool shaft, and the longitudinal direction length of said processing tank is longer than the longitudinal direction length of a portion of the film which is processed in the processing solution, said processing tank is sheath-shaped and the entrance/exit port for a film is formed only at the longitudinal direction one end of said processing tank.

In the eighth aspect, because the processing tank is sheath-shaped, the amount of processing solution is reduced, and the processing tank and the entire apparatus can be made even more compact.

DESCRIPTION OF THE PREFERRED EMBODIMENTS

[First Embodiment]

Figures 1A, 1B, 1C:
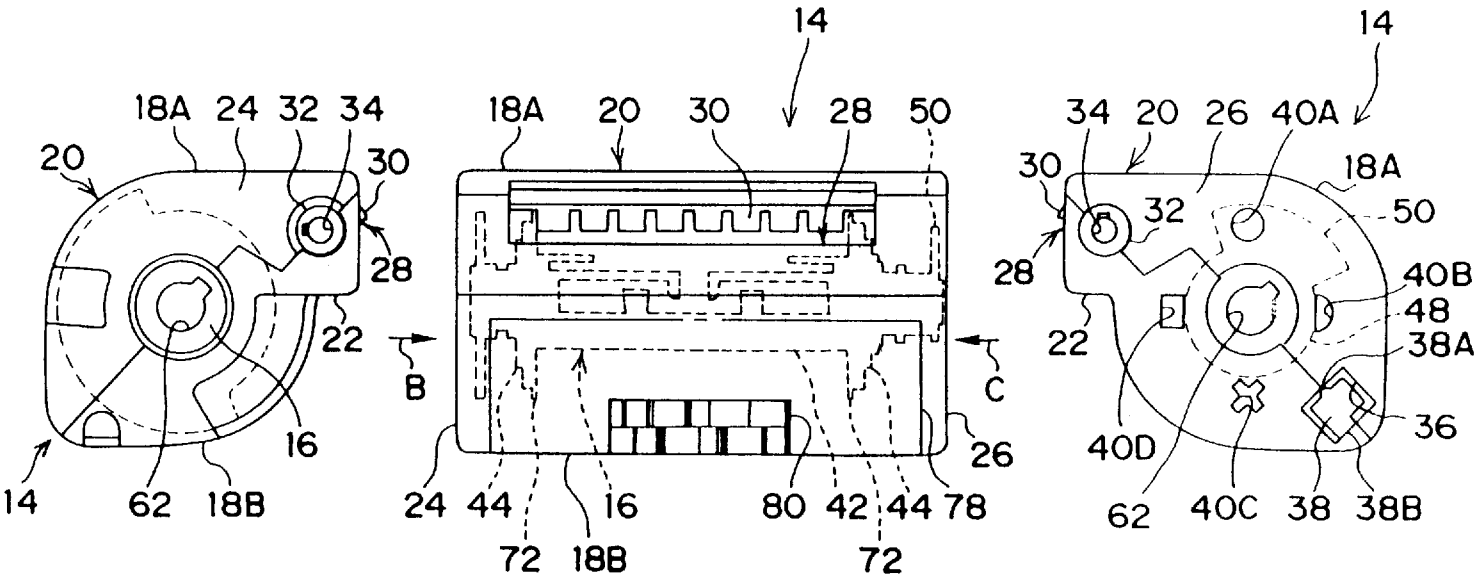
FIG. 1A is a left-hand side view of a cartridge.
FIG. 1B is an elevational view of the cartridge.
FIG. 1C is a right-hand side view of the cartridge.

A first embodiment of the present invention will be explained in accordance with FIGS. 1 through 14.

(Cartridge and Film)

Firstly, a cartridge 14 and a film FI used in the present invention will be schematically explained with reference to FIGS. 1 through 4.

As illustrated in FIGS. 1A through 1C and FIG. 2, the cartridge 14 serving as a film container includes a casing 20 which is formed in a substantially cylindrical shape by overlapping covers 18A and 18B. The film container used herein includes, for example, an APS film container (a cartridge 14) or a separate film container (including an intermediate magazine to which an intermediate spool shaft is attached) which takes up a 135-size negative film accommodated within a cartridge.

The casing 20 includes a protruding portion 22 which protrudes in a tangent direction thereof. An insertion opening 28, which runs along the axial direction of the casing 20 and serves as a slit-shaped entrance/exit port for a film, is formed at the distal end of the protruding portion 22. The insertion opening 28 is usually closed by a door 30 such that the interior of the casing 20 is shaded. Further, the spool shaft 16 within the casing 20 is rotatably supported by side walls 24, 26 which close the axial direction ends of the casing 20.

Figure 2:
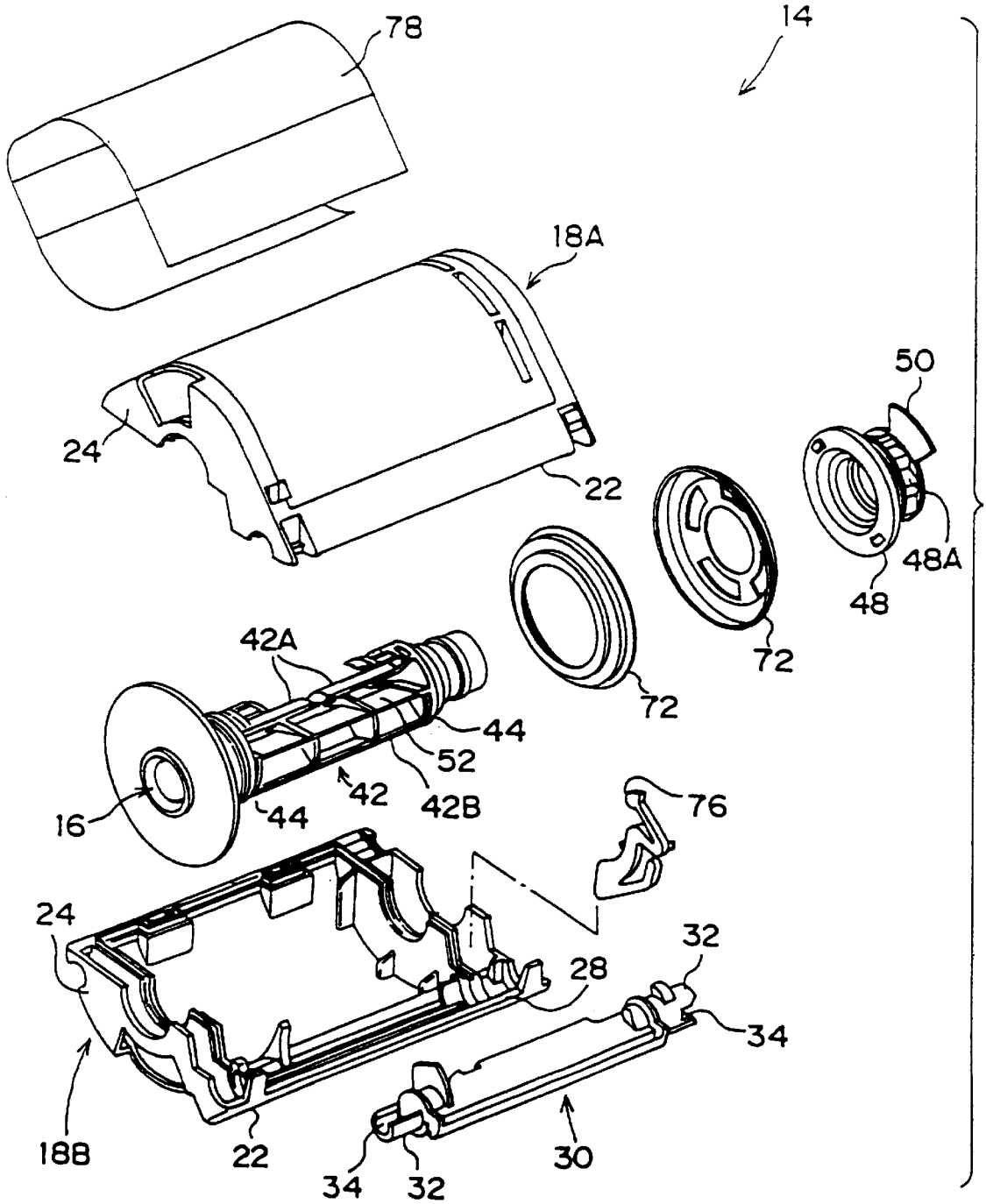
FIG. 2 is an exploded perspective view of the cartridge.

As shown in FIGS. 1A, 1C and 2, a door shaft 32 is suspended between side walls 24 and 26 and is rotatably supported at the protruding portion 22. The door shaft 32 rotates integrally with the door 30 such that the insertion opening 28 is opened/closed due to the rotation of the door 30 and the door shaft 32. An engagement key hole 34 serving as means for rotating the door shaft 32 (a door driver 158 which will be described later) is formed at the distal end of the door shaft 32 exposed from the side walls 24, 26.

The casing 20 is divided into the covers 18A and 18B along the line which connects the position at which the door shaft 32 is supported by the side walls 24, 26, the position at which the spool shaft 16 is supported, and the end portion at the side opposite the protruding portion 22.

As shown in FIG. 1C, at the other side wall 26 of the casing 20 and at the end portion at the side opposite the protruding portion 22, a notch hole 36 is formed by notches formed at the covers 18A, 18B. Moreover, an indication board 38 which covers the notch hole 36 extends along the cover 18B. The indication board 38 includes connecting portions 38A, 38B, and the narrow connecting portion 38A is connected to the axially central side of the casing 20 and the wide connecting portion 38B is connected to the outer peripheral portion side thereof.

When a developed film FI is accommodated within the cartridge 14, the connecting portion 38A side is removed and the indication board 38 is squeezed and bent into the notch hole 36. In this way, a determination can be made from the outer side of the causing 20 as to whether the film FI has been developed or not.

Further, at the side wall 26, indication holes 40A, 40B, 40C, 40D are punched at the periphery of the spool shaft 16 at equal intervals (hereinafter, the indication holes will be referred to as "indication holes 40" when used in a general term). The indication holes 40 are used to indicate the state of the film FI accommodated within the cartridge 14. For example, the circular indication hole 40A indicates that the film FI is unexposed; the semicircular indication hole 40B indicates that a portion of the film FI has been exposed; the X-shaped indication hole 40C indicates that the film FI has been exposed and undeveloped; and the rectangular indication hole 40D indicates that the film FI has been developed. In this way, the state of the film FI accommodated within the cartridge 14 can be determined.

Figure 3A:
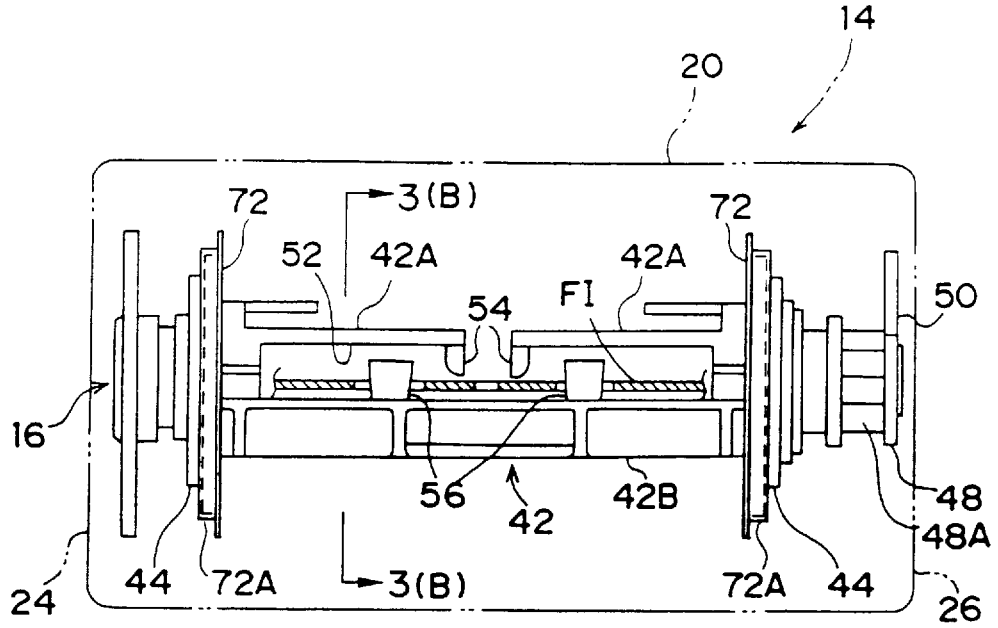
FIG. 3A is an elevational view of a spool shaft.
Figure 3B:
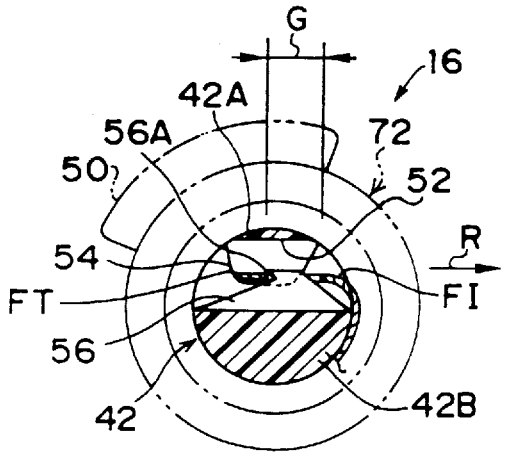
FIG. 3B is a cross-sectional view, taken along line 3(B)—3(B), of the spool shaft shown in FIG. 3A.

On the other hand, FIGS. 3A and 3B show the spool shaft 16 provided within the casing 20. A take-up portion 42 which takes up the film FI is provided at the intermediate portion of the spool shaft 16 in the axial direction thereof (right and left directions on the page surface in FIG. 3A). A flange portion 44 is disposed at both sides of the take-up portion 42.

As shown in FIG. 3A, a flexible flange 72 which is formed by a thin resin and can be elastically deformed is mounted to the flange portion 44.

Moreover, a ring 48 having small diameter is mounted to the end portion of the spool shaft 16 at the side wall 26 side of the casing 20. As shown in FIGS. 1C and 3B, a white board 50, which protrudes outwardly in the radial direction of the ring 48 in a predetermined width, is provided integrally at the ring 48. As shown in FIG. 1C, the white board 50 superposes on any one of the indication holes 40 in accordance with the rotational position which centers around the spool shaft 16 and the white portion is exposed within the superposed indication hole 40. The processing state of the film FI accommodated within the cartridge 14 is clearly indicated by the exposure position of the white board 50.

As shown in FIG. 2, a gear portion 48A is formed at the ring 48. When the door 30 is closed, a spool lock 76 mounted to the cover 18B engages the gear portion 48A such that the spool shaft 16 does not rotate at a predetermined torque or less. On the other hand, when the door 30 is opened, the spool lock 76 separates from the gear portion 48A such that the spool shaft 16 can rotate smoothly.

As shown in FIGS. 3A and 3B, a notch portion 52 which runs along the axial direction of the spool shaft 16 is formed at the take-up portion 42 of the spool shaft 16. The take-up portion 42 is divided into a wide take-up portion main body 42B and a narrow engaging portion 42A by the notch portion 52. Further, a pressing portion 54, which is divided into two at the axial direction intermediate portion of the engaging portion 42A and whose distal ends protrude toward the take-up portion main body 42B in the direction of narrowing the opening width of the notch portion 52 is formed at the engaging portion 42A.

On the other hand, a pair of projecting portions 56, which protrude at the outer side along the axial direction of the pressing portion 54 in the direction of narrowing the opening width of the notch portion 52, are formed at the take-up portion main body 42B. The projecting portions 56 superpose on the pressing portion 54, when viewed in the axial direction of the spool shaft 16.

As shown in FIGS. 1B and 2, a label 78 is adhered to the outer peripheral surface of the casing 20. As shown in FIG. 1B, a bar code 80 which includes various types of information such as a cartridge ID (identification number) for identifying the cartridge 14, the type of film, the photographed number of sheets (the number of frames) is printed on the cover 18B side in two columns.

Figure 4:
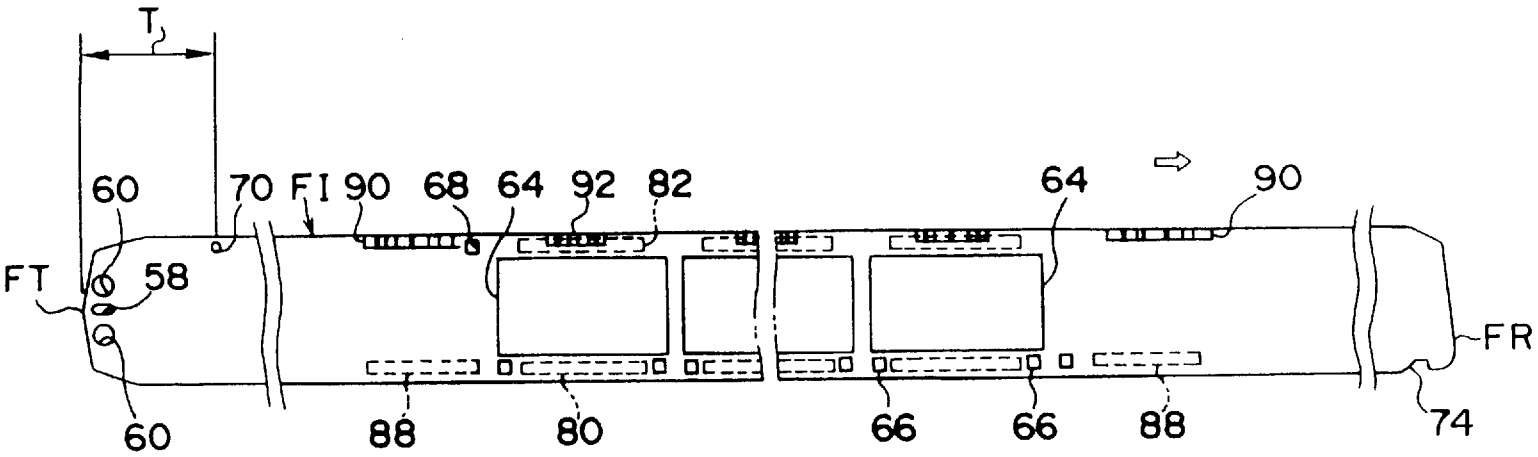
FIG. 4 is a plan view of a film.

As shown in FIG. 4, an elongated hole 58, which hooks on a pawl portion (unillustrated) of an attach plate which is used for engaging the film FI with the spool shaft 16 at the transverse direction central portion thereof, is punched at the trailer side end portion FT of the film FI.

An engaging hole 60 is punched at both sides of the elongated hole 58 in the transverse direction thereof. As shown in FIGS. 3A and 3B, when the trailer side end portion FT of the film FI is inserted through the notch portion 52 of the spool shaft 16, the above projecting portions 56 are inserted through the engaging holes 60. Further, the pressing portion 54 abuts a space between the engaging holes 60 of the film FI at this time so as to prevent the removal of the projecting portions 56, and the trailer side end portion FT of the film FI engages the spool shaft 16.

As shown in FIG. 3B, the distal end 56A of the projecting portion 56 protrudes in the direction opposite the withdrawing direction (the direction of arrow R) of the film FI so as to prevent the removal of the film FI.

The film FI is taken up onto the spool shaft 16 and accommodated within the cartridge 14 in a state in which the trailer side end portion FT engages with the spool shaft 16 as described above.

As shown in FIGS. 1A and 1C, at the cartridge 14, a key hole 62 is formed at the end surface of the spool shaft 16 exposed from the side walls 24, 26. When the film FI engages with the key hole 62, torque can be transmitted to the spool shaft 16.

As shown in FIG. 4, perforations 66 for indicating the position of an image frame 64 are formed at one end portion of the film FI in the transverse direction thereof at predetermined intervals. The perforations 66 are used for positioning the image frame 64 when the exposure of images or print operation is effected.

Further toward the end portion FT side than the last image frame 64, an around perforation 68 is punched at the side opposite the side of the perforations 66. The around perforation 68 is provided so as to clearly indicate that an image is not recorded or will not be recorded at the trailer side of the position of the around perforation 68.

Moreover, a detach perforation 70 is punched at the position which is a certain interval away from the trailer side end portion FT of the film FI. As far as the detach perforation 70 is detected, the position of the trailer side end portion FT of the film FI can be determined correctly. The transverse direction ends of the trailer side end portion FT of the film FI are inclined such that it is easy for the end portion FT to insert through the notch portion 52 of the spool shaft 16.

Furthermore, a transparent magnetic recording layer is provided at the film FI. An area at the transverse direction end portions of the film FI which does not hang over the image frames 64 is used as a magnetic track.

A magnetic track 80 for a processing laboratory is provided at the side at which the perforations 66 are formed. A magnetic track 82 for a camera is provided at the side opposite the side at which the perforations 66 are formed.

Further, a magnetic track 88, which records a Film ID for identifying the film FI, is provided further toward the end portion FT side than the perforation 66 of the image frame 64 at the end portion FT side and provided further toward the end portion FR side than the perforation 66 of the image frame 64 at the end portion FR side. Moreover, a bar code 90 is provided at the side opposite the magnetic film 88. The bar code 90 includes a film ID for identifying the film FI. The bar code 90 is formed in advance as a latent image at the time of manufacturing the film FI and an image is formed after the film FI was developed. The bar code 90 of the film FI corresponds to the bar code 80 of the aforementioned cartridge 14.

Furthermore, a bar code 92 is recorded onto the film FI at the position which is the same as that of the magnetic track 82. The bar code 92 indicates a frame number of the image frame 64, a manufacturer, a type of the film FI and the like. The bar code 92 is formed in advance as a latent image at the time of manufacturing the film FI and an image is formed after the film FI was developed.

(Development Processing Apparatus)

Figure 5:
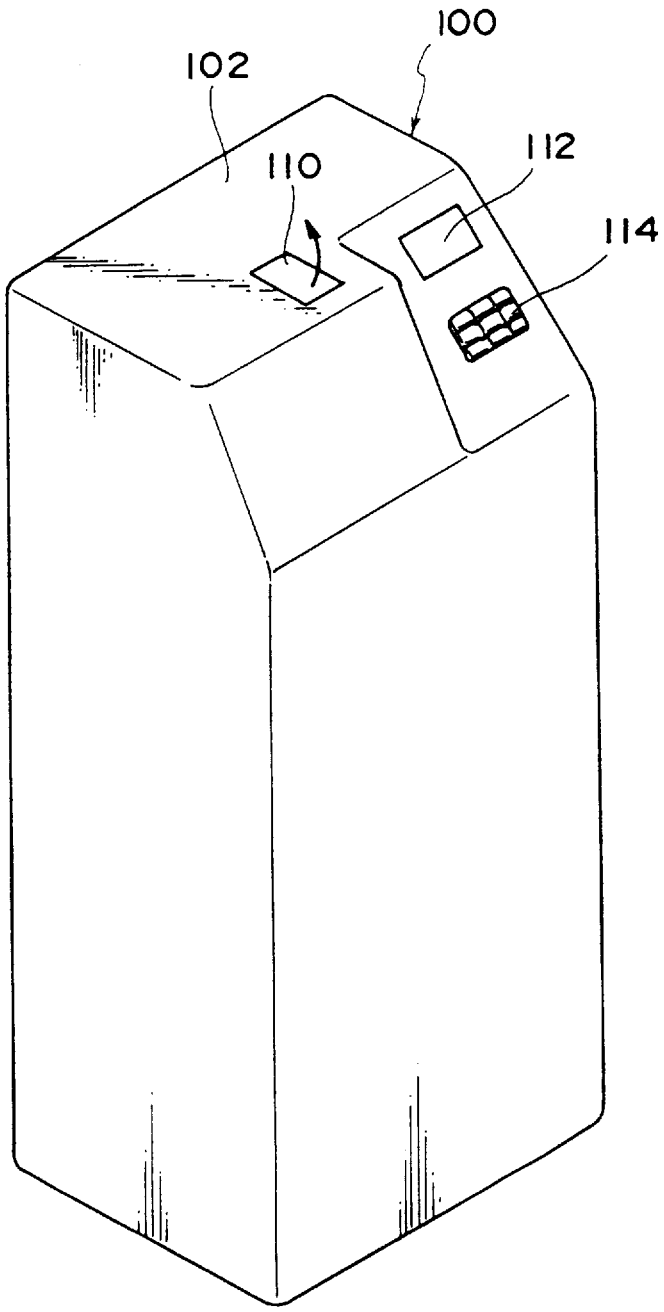
FIG. 5 is an overall perspective view of a development processing apparatus.

As shown in FIG. 5, a development processing apparatus 100 which undergoes development processing of the aforementioned film FI includes a box-shaped casing 102 for shading the interior thereof. An opening/closing lid 110, a display device 112, and a control panel 114 are provided at the upper portion of the casing 102.

Figure 6:
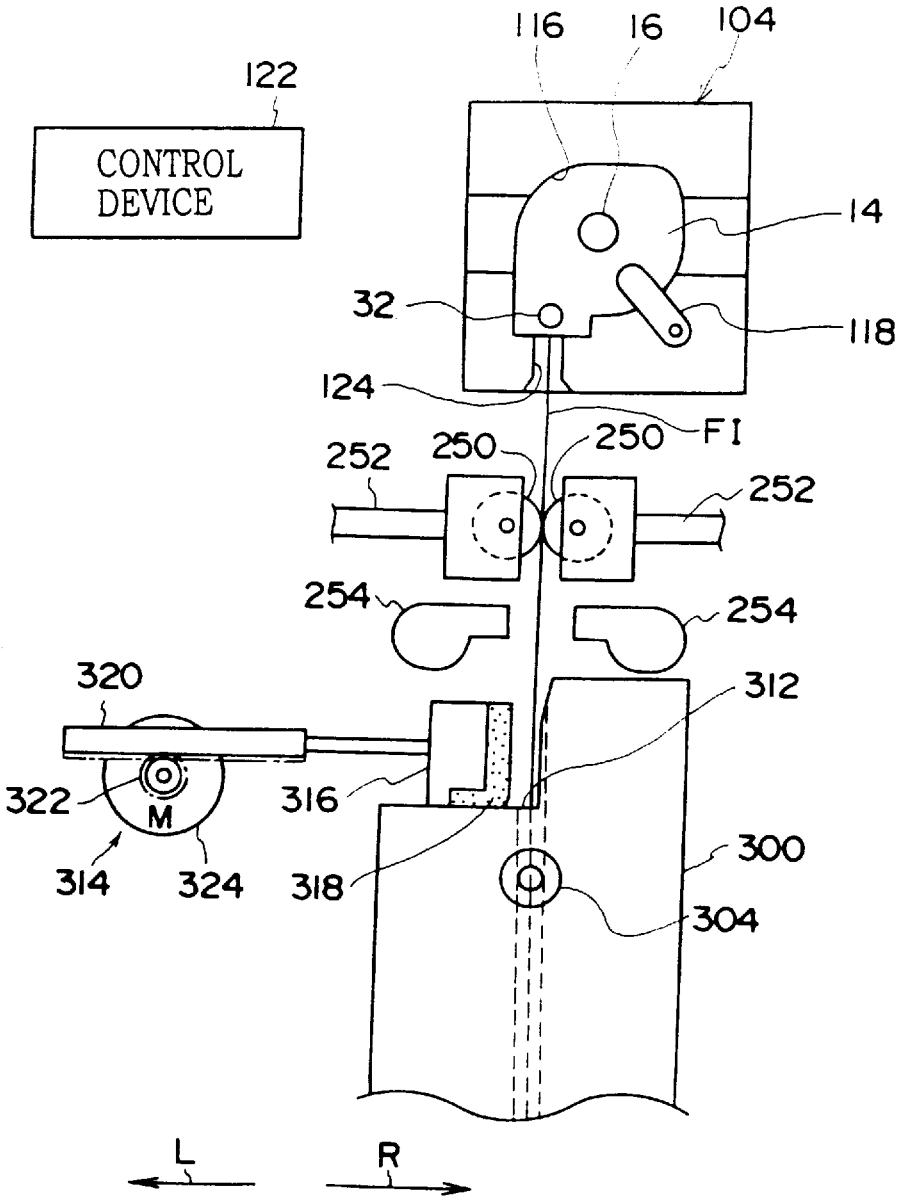
FIG. 6 is a side view of a film insertion mechanism.
Figure 7:
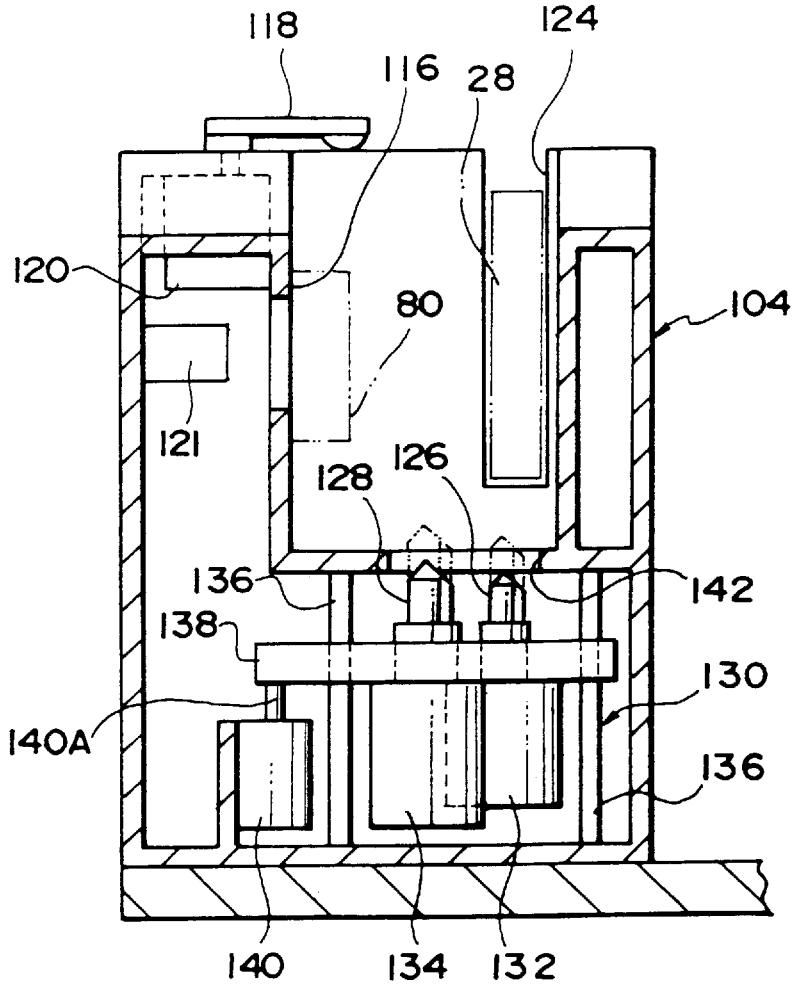
FIG. 7 is a cross-sectional view of a station.

As shown in FIGS. 6 and 7, a station 104 for loading the cartridge 14 is provided at the inner side of the casing 102.

The station 104 includes a concave portion 116 which loads the cartridge 14 and a rotational lever 118 which holds the cartridge 14 inserted into the concave portion 116. As shown in FIG. 7, the rotational lever 118 is rotated by a motor 120.

A bar code scanner 121, which reads the bar code 80 of the cartridge 14 shown in FIG. 1B, is provided at the station 104. The information on the bar code 80 read by the bar code scanner 121 is sent to a control device 122 (see FIG. 6) which forms a portion of processing solution supply means, to be described later.

As shown in FIG. 6, a notch 124 which enables the entering and exiting of the film FI from the cartridge 14 is formed at the station 104.

As shown in FIG. 7, the station 104 is provided with a chucking device 130 which includes a door driver 126, which opens and closes the door 30 (see FIG. 1B) of the cartridge 14, and a spool driver 128, which rotates the spool shaft 16 (see FIG. 1A).

The door driver 126 is rotated by a motor 132 and the spool driver 128 is rotated by a motor 134, and a key (projection) which engages a key hole is formed at the axial side surfaces of the door driver 126 and the spool driver 128. The motors 132, 134 are mounted to a slide plate 138 which is movably supported by a pair of guide rails 136 mounted to the station 104. The slide plate 138 slides in the axial direction of the spool shaft 16.

A movable iron core 140A of a solenoid 140 mounted to the station 104 is connected to the slide plate 138. As shown in FIG. 7, the door driver 126 and the spool driver 128 are usually withdrawn to positions which are predetermined distances away from the concave portion 116.

When electricity flows to the solenoid 140, the movable iron core 140A protrudes, the distal ends of the door driver 126 and the spool driver 128 protrude from an opening 142 formed at the bottom portion of the concave portion 116, and thereafter, the door driver 126 engages the key hole 34 of the door shaft 32 and the spool driver 128 engages the key hole 62 of the spool shaft 16.

The solenoid 140 of the station 104, the motor 120, the motor 132, and the motor 134 are controlled by the control device 122.

As shown in FIG. 6, a pair of guide rollers 250, which serve as conveying means and convey the film FI to a processing tank 300, which will be described later, are disposed below the station 104, i.e., between the cartridge 14 and the processing tank 300. These guide rollers 250 are connected to a movable iron core 252 of an unillustrated solenoid. The guide rollers 250 are slid to the left and right via the movable iron core 252 by turning on and off of the solenoid and taken from when the film FI is taken up or withdrawn.

A pair of dryers 254 for drying the developed film FI are disposed below the guide rollers 250 so that the dryers 254 face each other with the film FI therebetween. When the flilm FI is rewound into the cartridge 14, warm air (e.g., air heated at 60° C.) is blown to the film FI.

Figure 8:
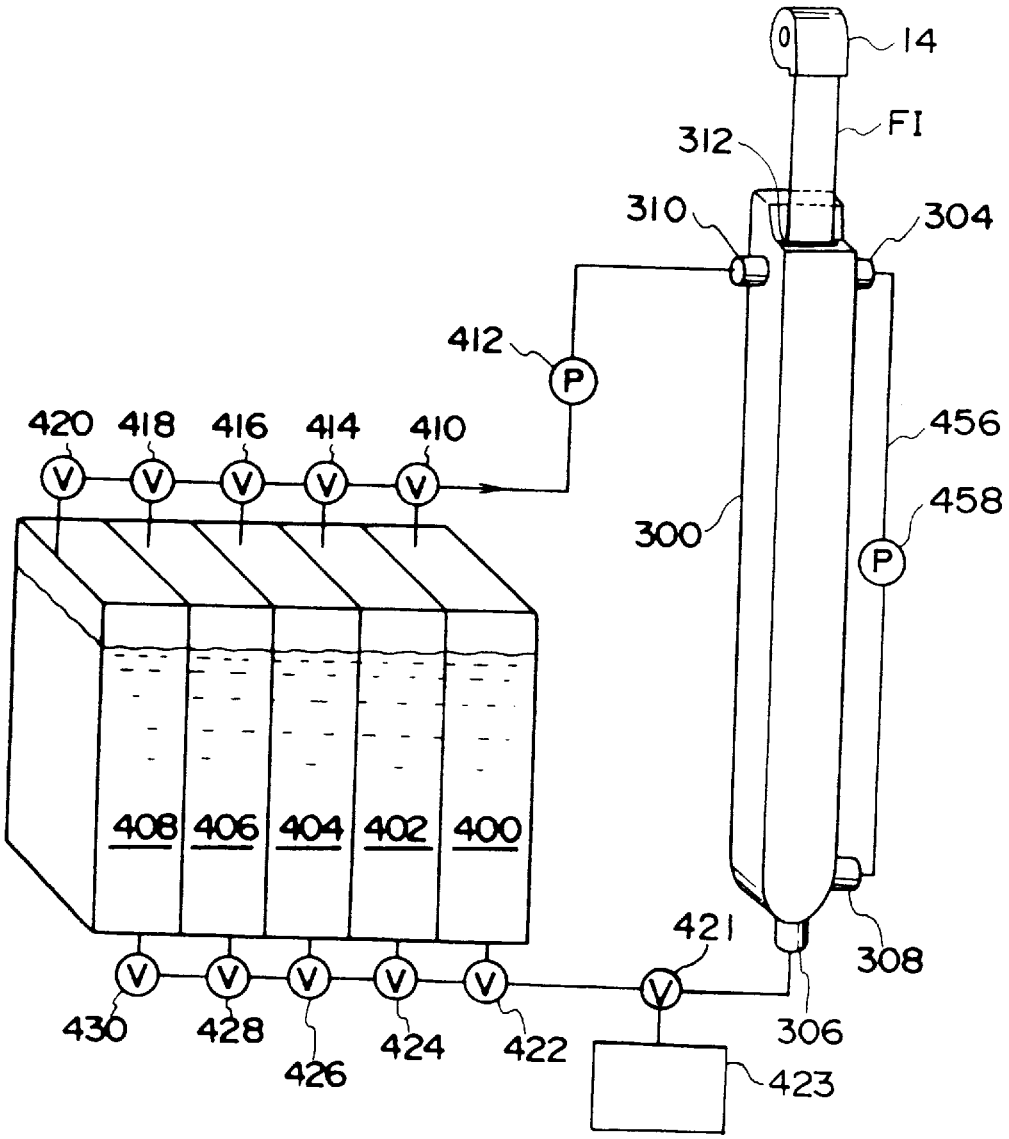
FIG. 8 is a piping view of the development processing apparatus.

As shown in FIG. 8, the processing tank 300, which is formed by a synthetic resin or the like and in the shape of a sheath for a sword, is disposed below the dryers 254 in the substantially vertical direction of the apparatus 100. The volume of the processing tank 300 of the first embodiment is 50 ml.

Figure 11:
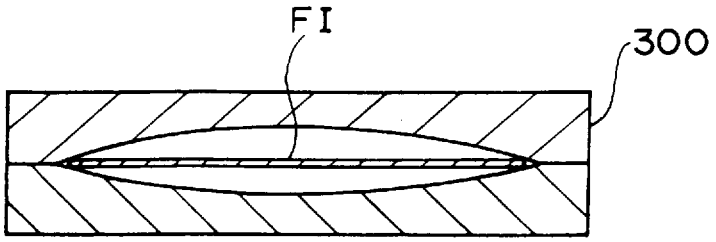
FIG. 11 is a cross-sectional view of a processing tank.
Figure 12:
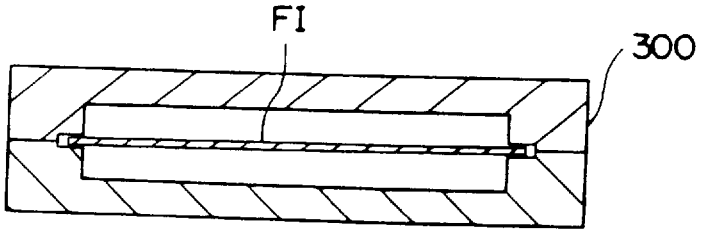
FIG. 12 is a cross-sectional view of a processing tank relating to another embodiment.

FIG. 11 shows the right-angle cross-sectional configuration of the interior of the processing tank 300 in the longitudinal direction thereof. The inner wall surfaces which oppose to each other are bent which that the interval between the transverse direction sides (the portions which oppose to the transverse direction end portions of the film FI) is narrow and the interval between the transverse direction central portions (the portions which oppose to the image frame 64 of the film FI shown in FIG. 4) is wide. As shown in FIG. 12, a groove may be formed at the position of the processing tank 300 which corresponds to the transverse direction side portions of the film FI. Alternatively, the transverse direction central portions of the inner wall surfaces may be wide and parallel.

When the film FI is inserted through an opening, transverse direction end portions of the film FI are guided by the transverse direction side portions of the inner side of the processing tank 300. Accordingly, the contact between the transverse direction central portion of the film FI, i.e., the image frame 64 and the processing tank 300 is prevented.

As shown in FIG. 8, a pipe-shaped connecting portion 304 which communicates with the interior of the processing tank 300 is provided at one of the upper side surfaces thereof, and a pipe-shaped connecting portion 310 which communicates with the interior of the tank 300 is provided at another of the upper side surfaces thereof.

Further, a pipe-shaped connecting portion 308 which communicates with the interior of the processing tank 300 is provided at one of the lower side surfaces thereof, and a pipe-shaped connecting portion 306 which communicates with the interior of the processing tank 300 is provided at the lower end thereof.

As shown in FIG. 6, a portion of the upper end of the processing tank 300 is notched, and a sealing device 314 is provided at the position which opposes a film insertion opening 312 formed at the notch.

The sealing device 314 includes a block 316 adhered to the film insertion opening 312. A thick packing 318 formed by an elastic body such as a rubber is adhered to a portion of the block 316 adhered to the film insertion opening 312.

The block 316 is connected to a rack 320. As a pinion which engages the rack 320 is rotated by a motor 324, the opening of the processing tank 300 is closed by the packing 318. In this way, the interior of the processing tank 300 can be sealed.

As shown in FIG. 8, the development processing apparatus 100 is provided with a color developer stock tank 400 which stores color developer, a bleaching solution stock tank 402 which stores bleaching solution, a fixing solution stock tank 404 which stores fixing solution, a washing solution stock tank 406 which stores washing solution, and a stabilizer stock tank 408 which stores stabilizer. The tanks 400, 402, 404, 406, 408 form a part of the processing solution supply means. The volume of each tank is 500 ml.

The color developer is supplied to the processing tank 300 via a solenoid valve 410 which forms a part of the processing solution supply means, a reciprocally rotatable pump 412, and the connecting portion 310. The bleaching solution is supplied to the processing tank 300 via a solenoid valve 414 which forms a part of the processing solution supply means, the solenoid valve 410, the pump 412, and the connecting portion 310. The fixing solution is supplied to the processing tank 300 via solenoid valves 416, 414, 410, the pump 412, and the connecting portion 310. The washing solution is supplied to the processing tank 300 via solenoid valves 418, 416, 414, 410, the pump 412, and the connecting portion 310. The stabilizer is supplied to the processing tank 300 via solenoid valves 420, 418, 416, 414, 410, the pump 412, and the connecting portion 310.

The solenoid valve 420 is an opening/closing valve and the solenoid valves 410, 414, 416, 418 are three-way valves.

Further, the color developer which has passed through the processing tank 300 is supplied to the color developer stock tank 400 via a solenoid valve 422. The bleaching solution which has passed through the processing tank 300 is supplied to the bleaching solution stock tank 402 via solenoid valves 422, 424. The fixing solution which has passed through the processing tank 300 is supplied to the fixng solution stock tank 404 via solenoid valves 422, 424, 426. The washing solution which has passed through the processing tank 300 is supplied to the washing solution stock tank 406 via solenoid valves 422, 424, 426, 428. The stabilizer which has passed through the processing tank 300 is supplied to the stabilizer stock tank 406 via solenoid valves 422, 424, 426, 428, 430.

A waste solution tank 423 is connected to a solenoid valve 421 between the connecting portion 306 and the solenoid valve 422. The solenoid valve 430 is an opening/closing valve and the solenoid valves 421, 422, 424, 426, 428 are three-way valves.

When processing at one solution is completed, the pump 412 is rotated reversely such that the processing solution within the processing tank 300 is returned to the original stock tank and the interior of the processing tank 300 becomes empty. Thereafter, the next processing solution is supplied to the processing tank 300.

The connecting portions 304, 308 are connected by a piping 456. The processing solution within the processing tank 300 is circulated by a reciprocally rotatable pump 458 provided in the middle of the piping 456.

A description will be given of the structures of color developer stock tank 400, bleaching solution stock tank 402, fixing solution stock tank 404, washing solution stock tank 406, and stabilizer stock tank 408 will be explained. Because the structures of these tanks are the same, the structure of color developer stock tank 400 will be described in detail on behalf of the others.

Figure 9:
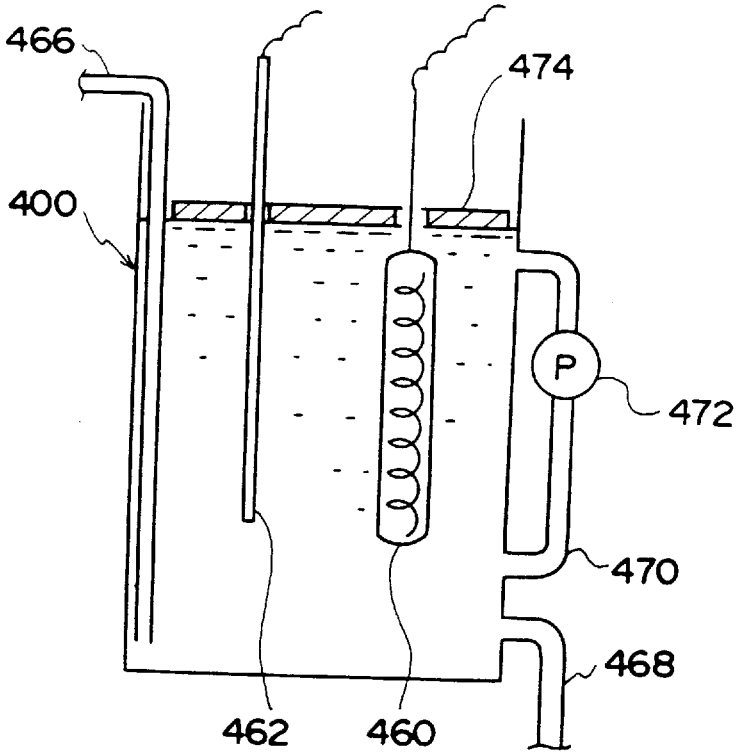
FIG. 9 is a structural view of a stock tank.

As shown in FIG. 9, a heater 460, a temperature sensor 462, and a piping 466 are inserted into the color developer stock tank 400. The heater 460 heats the color developer, the temperature sensor 462 measures the temperature of the color developer, and the piping 466 communicates with the connecting portion 310 of the processing tank 300 shown in FIG. 8 and supplies the color developer to the processing tank 300 via the pump 412.

The heater 460 and the temperature sensor 462 are connected to the control device 122 shown in FIG. 6 such that the temperature of the processing solution is controlled to a predetermined temperature.

A piping 468, which collects the color developer within the processing tank 300 shown in FIG. 8, is connected to the lower portion of the color developer stock tank 400.

A floating lid 474 is floated in the color developer stock tank 400. The floating lid 474 is provided so that the horizontal direction cross-sectional configuration of the color developer processing tank 400 is constant in the vertical direction thereof, the surface area of the stored color developer which contacts outside air is minimized, and lowering of the temperature of the solution due to spontaneous heat dissipation to the outside air is prevented.

Figure 10:
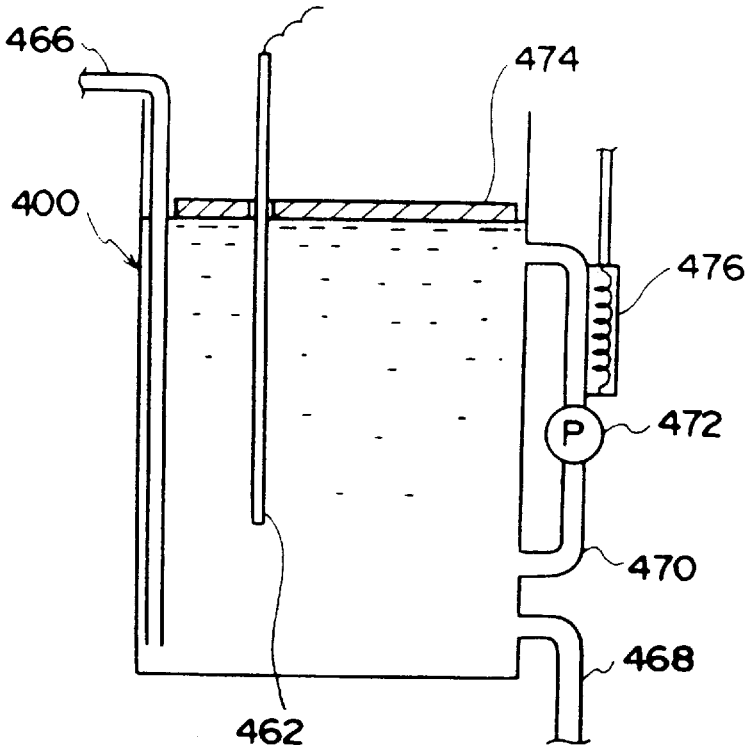
FIG. 10 is a structural view of a stock tank relating to another embodiment.

As shown in FIG. 10, a method of heating the processing solution may include heating a piping 470 for circulation by a casting heater 476 and heating the processing solution indirectly. Further, the heater may be disposed directly within the processing tank 300. The temperature of the processing solution is raised to a set temperature (e.g., 38° C.) by the heater (including the casting heater 476 and the like) shown in FIG. 9 via the temperature sensor 462, and the temperature of the processing tank 300 is held at a predetermined temperature by the heated processing solution.

A piping 470 and a pump 472 for circulating the stored color developer and keeping the composition and temperature of the solution uniform is mounted to the color developer stock tank 400. As a result, in a state in which the film insertion opening 312 is closed by the sealing device 314 as shown in FIG. 6, the last processing solution is circulated and the processing tank 300 is lagged. Therefore, the temperature of the processing tank 300 can be invariably made constant.

(Operation)

Next, the operation of the first embodiment will be explained.

As shown in FIG. 6, in an initial state of the development processing tank 100, the guide rollers 250 are separated and the block 316 is separated from the film insertion opening 312 of the processing tank 300.

The opening/closing lid 110 shown in FIG. 5 is opened. As shown in FIG. 6, the cartridge 14 accommodating the undeveloped fllm FI is loaded into the concave portion 116 of the station 104 and then the opening/closing lid 110 is closed.

When a start button of the control panel 114 shown in FIG. 5 is turned on, the rotational lever 118 shown in FIG. 6 is rotated so as to hold the cartridge 14.

Next, the chucking device 130 shown in FIG. 7 is operated such that the door driver 126 engages the key hole 34 of the door shaft 32 and the spool driver 128 engages the key hole 62 of the spool shaft 16.

The door driver 126 is rotated by the motor 132 and the door 30 is opened. Thereafter, the spool driver 128 is rotated by the motor 134 and the film FI is conveyed out of the cartridge 14 through the insertion opening 28.

As shown in FIG. 6, when the film FI is conveyed out of the cartridge 14, the guide rollers 250 are rotated. The film FI passes between the guide rollers 250 and is inserted into the processing tank 300.

When the insertion of the film FI into the processing tank 300 is completed, the block 316 presses the film insertion opening 312 and the interior of the processing tank 300 is sealed.

Next, a process for developing the film FI in the processing solutions will be explained.

As shown in FIG. 8, when the processing tank 300 is sealed, the pump 412, the solenoid valves 410, 414, 416, 418, 420, 422, 424, 426, 428, 430 are operated by the control device 122 shown in FIG. 6 in a predetermined order. The processing tank 300 is filled with the color developer, the bleaching solution, the fixing solution, the washing solution, the heated stabilizer in that order. The film FI is thereby developed.

In a case in which the film FI is processed in one solution, the pump 412 is operated such that the solution is circulated in one way between the stock tank and the processing tank 300. Occasionally, the pump 412 is stopped and the pump 458 is operated such that the solution within the processing tank 300 is circulated in the opposite direction. Consequently, the elongated film FI can be stably processed over the longitudinal direction thereof.

When the processing in one processing solution is completed, the processing solution within the processing tank 300 and the piping 456 is returned to the original stock tank via the connecting portion 306 by the pump 412. The processing tank 300 and the piping 456 become temporarily empty. Thereafter, the solenoid valve is switched, the pump 412 is operated, and the next processing solution is supplied to the processing tank 300.

Because the processing tank 300 is invariably filled with the processing solution in this way, the interior of the processing tank 300 is not dried. Accordingly, crystal formed by a plurality of types of processing solutions due to drying is not generated and the interior of the processing tank 300 will not be contaminated.

When the film FI is processed in the color developer, the bleaching solution, the fixing solution, the washing solution and the stabilizer in that order, the block 316 of the sealing device 314 separates from the film insertion opening 312.

Next, when the spool driver 128 is rotated and the entire film FI is wound around the spool shaft 16 of the cartridge 14, the door 30 is closed and the door driver 126 and the spool driver 128 separate form the cartridge 14. When the film FI is rewound into the cartridge 14, warm air is blown to the surfaces of the film FI by the dryers 254 shown in FIG. 6 so as to dry the film FI.

Thereafter, the rotational lever 118 is rotated and the cartridge 14, which accommodates the developed film FI, is taken from the concave portion 116 and removed by opening the opening/closing lid 110.

Figure 13:
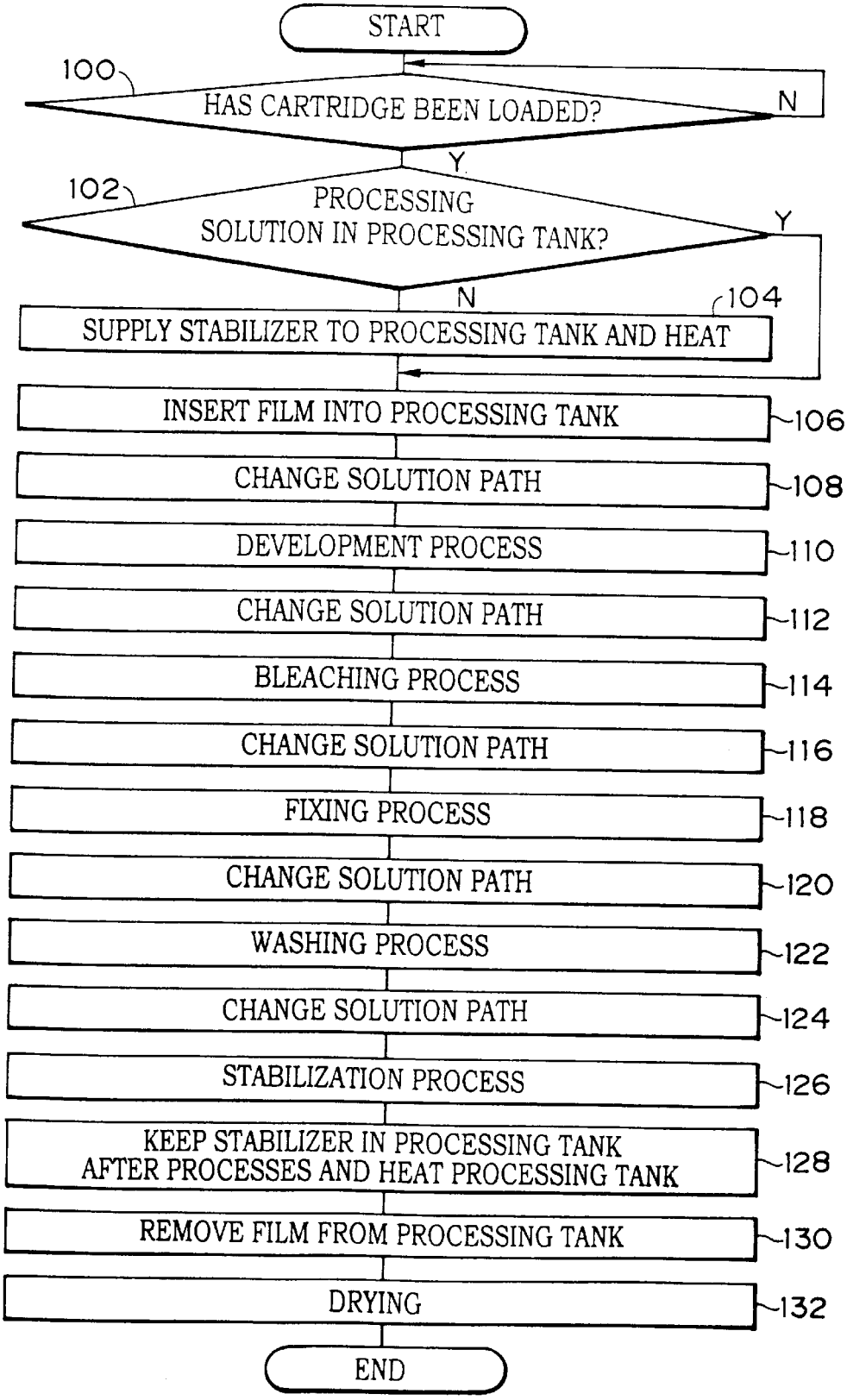
FIG. 13 is a flowchart for heating process of the processing tank relating to a first embodiment.

A process for heating the processing tank will be described with reference to a flowchart shown in FIG. 13.

In step 100, a determination is made as to whether the cartridge 14 has been loaded. If the answer to the determination in step 100 is "Yes", in step 102, a determination is made as to whether there is processing solution within the processing tank 300. If the answer to the determination in step 102 is "No", in step 104, the heated stabilizer is supplied to the processing tank 300 and the processing tank 300 is heated. In step 106, the film FI is inserted into the processing tank 300. If the answer to the determination in step 102 is "Yes", the processing in step 106 is effected.

Thereafter, in step 108, the solution path is changed and the stabilizer within the processing tank 300 is returned to the original stock tank 408. Then, the color developer is supplied to the processing tank 300 and development process is effected in step 110. In this case, a part or all of the stabilizer held in the processing tank 300 may be supplied to the waste solution tank 423 to be discharged. Further, in a case in which the solution is supplied to the processing tank 300 as the processing solution in the prior process is extruded by the processing solution in the posterior process, a portion (proximal portion) of the extruded processing solution which is pressed may mix somewhat with a portion (distal portion) of the extruding processing solution which presses. As a result, the portion of the processing solution which may be mixed somewhat is discharged to the waste solution tank 423 as waste solution and mixing of different types of processing solutions is thereby prevented.

In step 112, the solution path is changed and the bleaching solution is supplied to the processing tank 300. In step 114, bleaching process is effected. In step 116, the solution path is changed and the fixing solution is supplied to the processing tank 300. In step 118, fixing process is effected. In step 120, the solution path is changed and the washing solution is supplied to the processing tank 300. In step 122, washing process is effected. In step 124, the solution path is changed and the stabilizer is supplied to the processing tank 300. In step 126, stabilization process is effected.

In step 128, the stabilizer is not discharged from the processing tank 300 and is kept therein for heating the processing tank 300. In step 130, the film FI is removed from the processing tank 300. In step 132, the film FI is dried by the dryers 254 and pulled into the cartridge 14. Instead of the last processing solution (stabilizer), washing water may be filled within the processing tank 300 beforehand.

In accordance with the development processing apparatus 100 of the present embodiment, since the processing tank 300 is lagged by the heated last processing solution upon insertion of the film FI, the development processing can be carried out rapidly at optimal temperature.

As another embodiment, a description will be given of a case in which the color developer is filled in the processing tank 300 beforehand.

In this case, the processing solution is filled within the processing tank 300 before the insertion of the film FI, and the film FI is inserted in this state. Thus, in accordance with the first embodiment, even if the film FI interferes with (abuts) the inner walls of the processing tank 300 upon insertion of the film FI, the film FI does not attach and adhere to the inner walls thereof. Accordingly, conveyance deficiency upon insertion of the film FI into the processing tank 300 is prevented.

Therefore, in accordance with the development processing apparatus 100 of the first embodiment, it is not necessary to provide drawing means for drawing the film FI into the processing tank 300 and to change a material of inner walls of the processing tank 300 to the material which improves the sliding of the film FI. Further, the film FI can be conveyed to the processing tank 300 easily and reliably by the apparatus having a simple structure.

[Second Embodiment]

A second embodiment of the present invention will be explained in accordance with FIGS. 14 through 18. Structures which are similar to those of the aforementioned embodiment are designated by the same reference numerals, and descriptions thereof are omitted.

Figure 14:
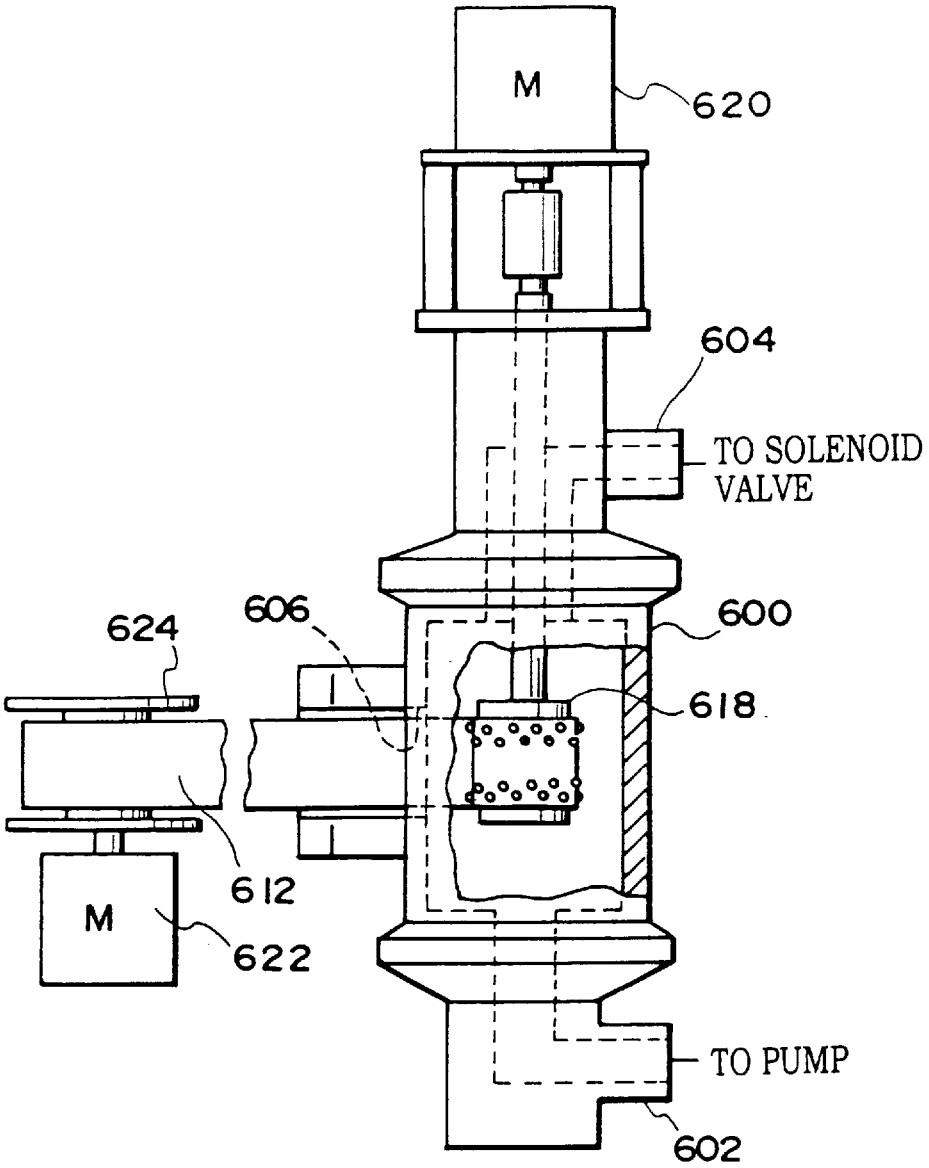
FIG. 14 is a side view of a processing tank of a development processing apparatus relating to a second embodiment.
Figure 15:
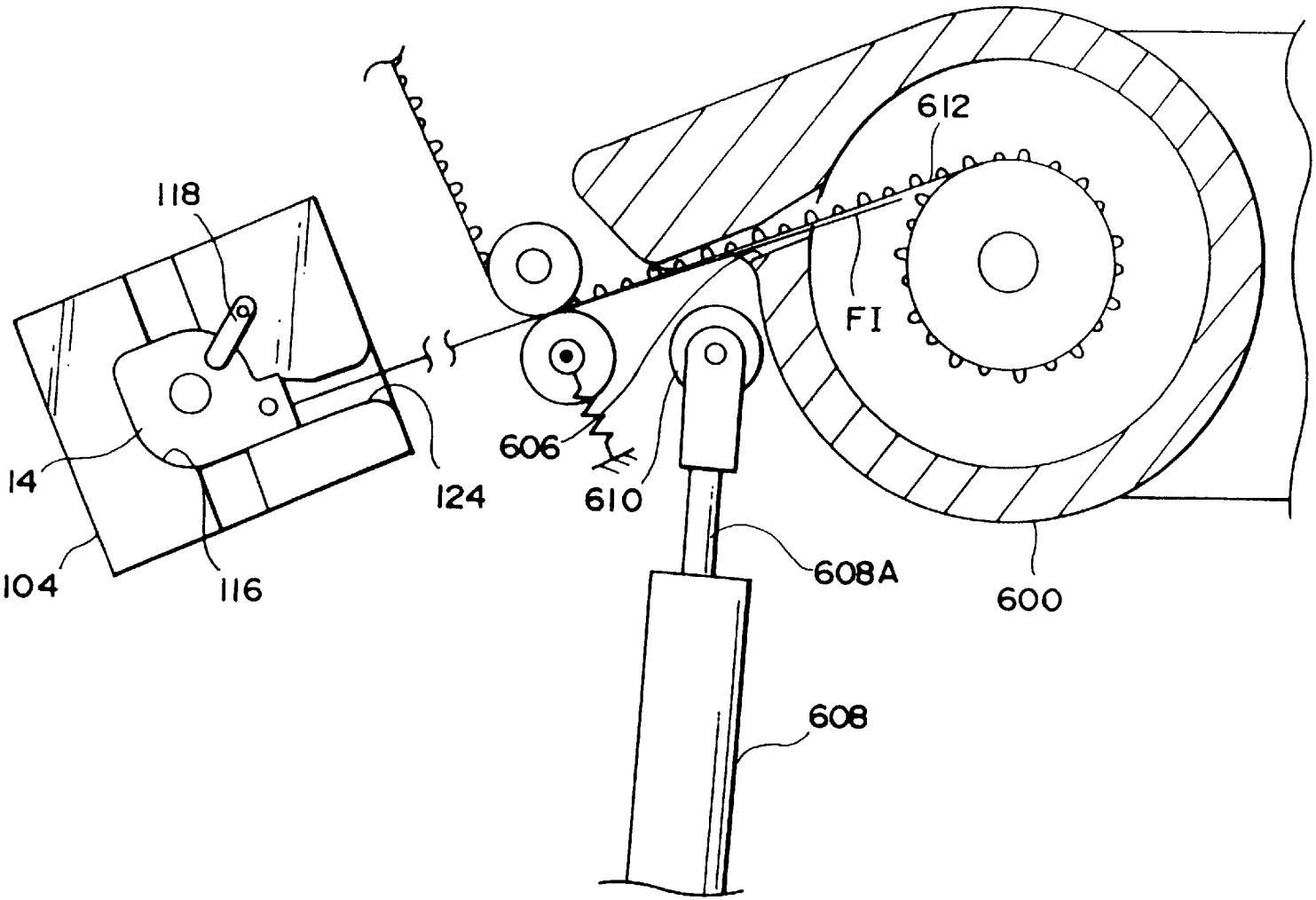
FIG. 15 is a cross-sectional view, perpendicular to the axis, of the processing tank shown in FIG. 14.

As shown in FIGS. 14 and 15, a processing tank 600 of the second embodiment has an inner space whose cross-sectional configuration is circular.

As shown in FIGS. 14, a pipe-shaped connecting portion 602 is integrally formed at the lower side surface of the processing tank 600 and a pipe-shaped connecting portion 604 is integrally formed at the upper side surface thereof.

The connecting portion 602 communicates with the pump 412 (see FIG. 8) and the connecting portion 604 communicates with the solenoid valve 422 (see FIG. 8).

As shown in FIGS. 14 and 15, a slit-shaped film insertion opening 606 whose width is slightly larger than the width of the film FI is formed at the side surface of the processing tank 600.

As shown in FIG. 15, a cylinder 608 which forms a portion of a sealing device is disposed on the side of the processing tank 600. A packing 610 formed by an elastic body such as a rubber is mounted to the distal end of a cylinder rod 608A and the film insertion opening 606 can be closed by the packing 610.

Further, as shown in FIG. 14, a take-up shaft 618 rotated by a motor 620 is disposed at the axially central portion of the processing tank 600 and one end of an embossing film 612, which will be described later, engages the take-up shaft 618. Moreover, the other end of the embossing film 612 engages a take-up drum 624 rotated by a motor 622.

In the processing tank 600, the film FI is accommodated within the tank 600 which is taken up along with the embossing film 612. The embossing film 612 has a configuration shown in FIGS. 16 through 18 and is formed by a synthetic resin or the like.

Figure 16:
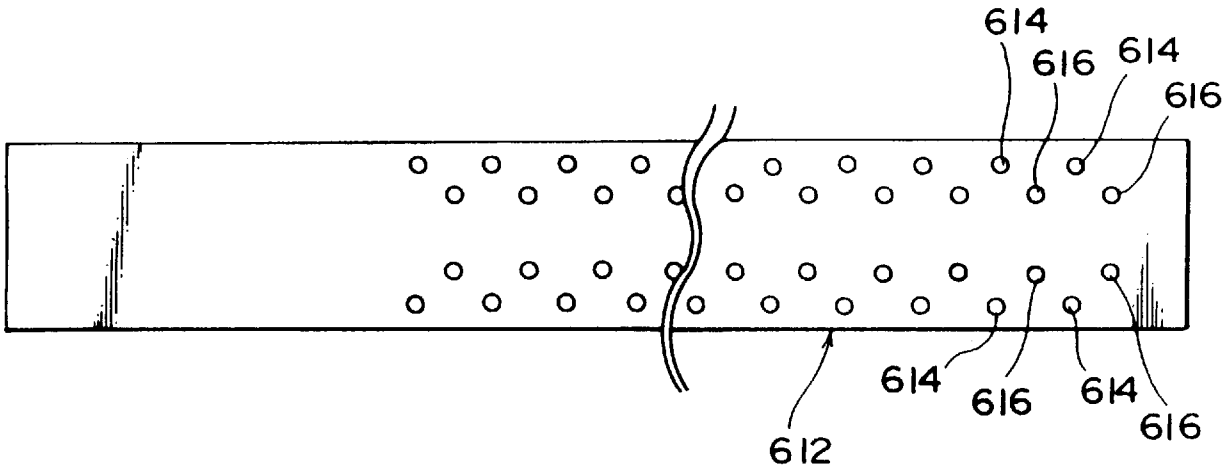
FIG. 16 is a plan view of an embossing film.
Figure 17:
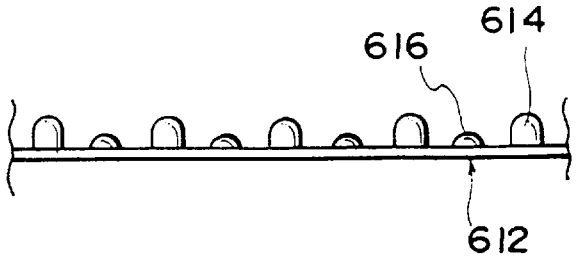
FIG. 17 is a side view of the embossing film.

At transverse direction sides of the embossing film 612, high projections 614 are formed at predetermined intervals in the longitudinal direction thereof. At the inner sides of the high projections 614, low projections 616 are formed at predetermined intervals in the longitudinal direction thereof. As shown in FIG. 16, an area having no high projections 614 and low projections 616 is formed at the side (the left-hand side in FIG. 16) of the embossing film 612 engaged with the take-up drum 624. When the tank 600 is sealed by the packing 610, the area is positioned at the film insertion opening 606.

Figure 18:
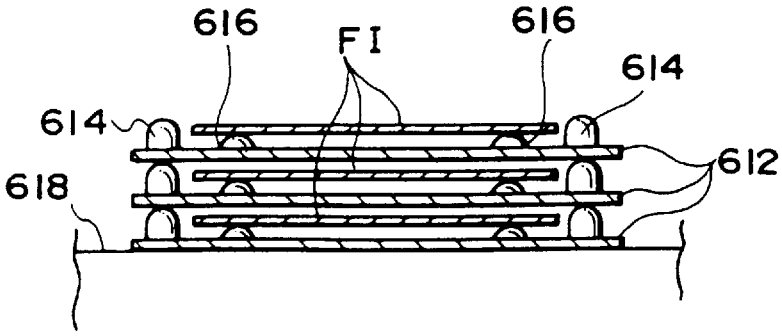
FIG. 18 is a cross-sectional view of a film and the embossing film wound together.

In the second embodiment, as shown in FIG. 18, the film FI conveyed out of the cartridge 14 is placed between the high projections 614 and on the low projections 616. Thereby, the film FI is taken up onto the take-up shaft 618 of the processing tank 600 shown in FIG. 15 along with the embossing film 612.

When the film FI is taken up onto the take-up shaft 618 along with the embossing film 612, the low projections 616 contact the surface opposite an emulsion surface of the film FI. Accordingly, as shown in FIG. 18, a gap for circulating processing solution is formed at both surfaces of the film FI.

Namely, in the second embodiment, the processing solution within the tank 600 flows in the shortened transverse direction of the film FI.

In the processing tank 600 of the second embodiment as well, the processing tank 600 is filled with color developer, bleaching solution, fixing solution, washing solution, and stabilizer in that order and the film FI is developed in the same manner as that of the aforementioned first embodiment.

The configuration of the inner space of the processing tank 600 of the second embodiment is cylindrical and the volume of the processing tank 600 is as small as that of the above processing tank 300. Therefore, a stable performance can be obtained even in a small processing amount in the second embodiment.

Figure 19:
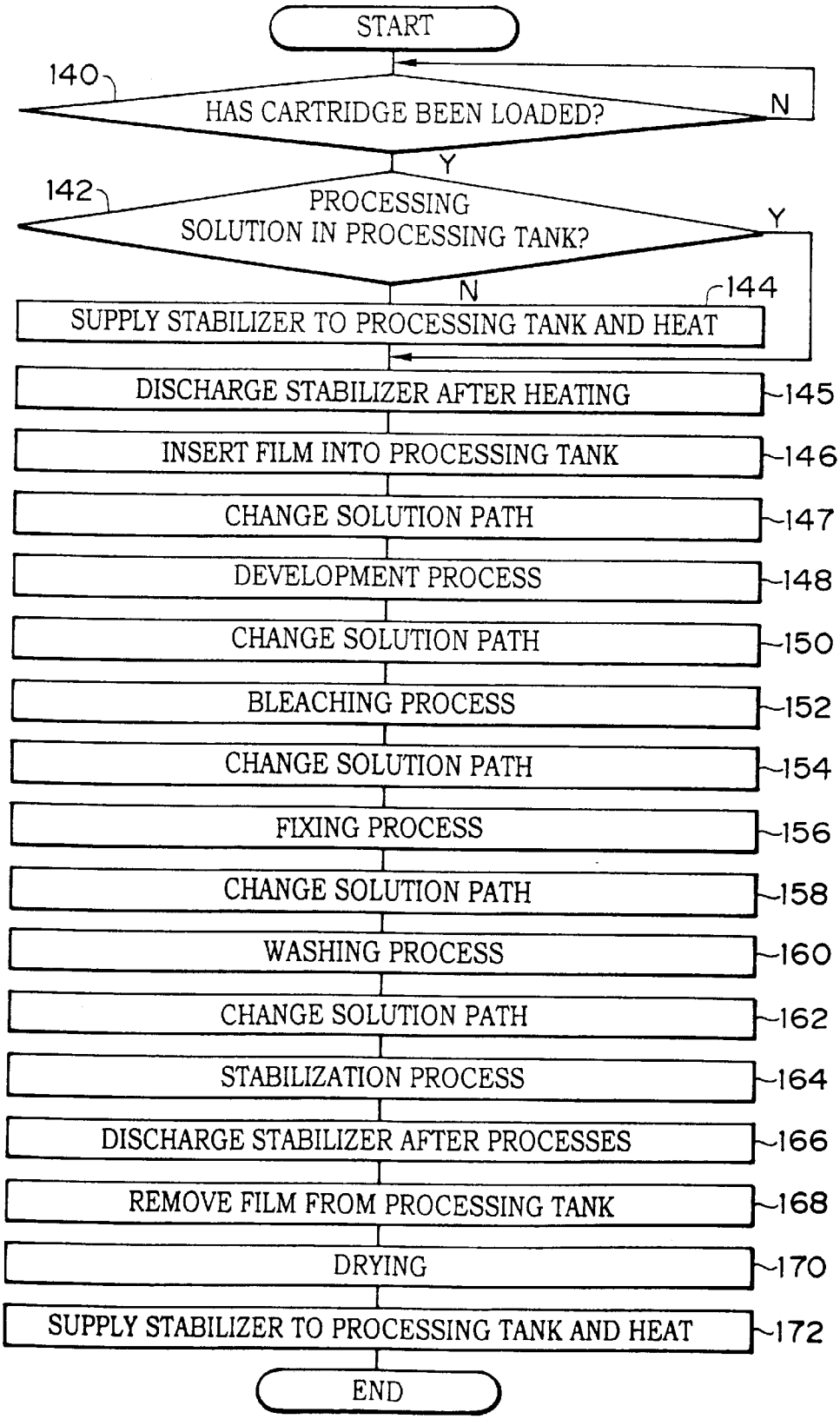
FIG. 19 is a flowchart for heating process of the processing tank relating to the second embodiment.

A process for heating the processing tank 600 will be explained on the basis of a flowchart shown in FIG. 19.

In step 140, a determination is made as to whether the cartridge 14 has been loaded. If the answer to the determination in step 140 is "Yes", in step 142, a determination is made as to whether there is processing solution within the processing tank 600. If the answer to the determination in step 142 is "No", in step 144, the heated stabilizer is supplied to the processing tank 600 and the processing tank 600 is heated. In step 145, the processing tank 600 is heated, and thereafter, the stabilizer is discharged therefrom. In step 146, the film FI is inserted into the processing tank 600. If the answer to the determination in step 142 is "Yes", the processing in step 145 is effected, and thereafter, the processing in step 146 is effected.

Thereafter, in step 147, the solution path is changed and the color developer is supplied to the processing tank 600. In step 148, development process is effected. In step 150, the solution path is changed and the bleaching solution is supplied to the processing tank 600. In step 152, bleaching process is effected. In step 154, the solution path is changed and the fixing solution is supplied to the processing tank 600. In step 156, fixing process is effected. In step 158, the solution path is changed and the washing solution is supplied to the processing tank 600. In step 160, washing process is effected. In step 162, the solution path is changed and the stabilizer is supplied to the processing tank 600. In step 164, stabilization process is effected.

In step 166, the stabilizer is discharged from the processing tank 600. In step 168, the film FI is removed from the processing tank 600. In step 170, the film FI is dried by the dryers 254. After the film FI is removed in step 168, in step 172, the stabilizer is again supplied to the processing tank 600 and heats the processing tank 600.

Because the other structures, operations, and effects are the same as those of the first embodiment, descriptions thereof are omitted.

In the above embodiments, the film FI is an APS film. However, the film used in the present invention is not limited to the same, and a film such as a 135-size film or the like can be used in the same way.

What is claimed is:

1. A development processing apparatus comprising:

a plurality of stock tanks which stores a plurality of types of processing solutions;

a small-volume single processing tank including an entrance/exit port for an elongated film which enables the entering/exiting of the film, the processing tank accommodating the film via the entrance/exit port for a film and developing the film in the plurality of types of processing solutions;

processing solution supply means which supplies the plurality of types of processing solutions from said plurality of stock tanks to said processing tank in a predetermined order;

a sensor which measures the temperature of the processing solution within said processing tank;

a heater which is disposed at one of said stock tanks and said processing solution supply means and heats the processing solution; and control means which is connected to said processing solution supply means and said heater and controls said processing solution supply means such that the last processing solution supplied to said processing tank is filled within said processing tank even after the film is removed from said processing tank, and said control means controlling said heater such that the temperature of the last processing solution is set to a predetermined temperature and that said processing tank is lagged by the last processing solution heated by said heater.

2. A development processing apparatus according to claim 1, further comprising:

a sealing device which closes the entrance/exit port for a film.

3. A development processing apparatus according to claim 1, further comprising:

conveying means which, in a state in which the longitudinal direction one end of the elongated film is engaged with a spool shaft and in which the film is taken up onto the spool shaft from the longitudinal direction one end of the film, conveys the film out of a film container accommodating the film from the longitudinal direction other end of the film and maintains a state in which the longitudinal direction one end of the film is engaged with the spool shaft, wherein the longitudinal direction length of said processing tank is longer than the longitudinal direction length of a portion of the film which is processed in the processing solution, said processing tank is sheath-shaped and the entrance/exit port for a film is formed only at the longitudinal direction one end of said processing tank.

4. A development processing apparatus according to claim 2, further comprising:

conveying means which, in a state in which the longitudinal direction one end of the elongated film is engaged with a spool shaft and in which the film is taken up onto the spool shaft from the longitudinal direction one end of the film, conveys the film out of a film container accommodating the film from the longitudinal direction other end of the film and maintains a state in which the longitudinal direction one end of the film is engaged with the spool shaft, wherein the longitudinal direction length of said processing tank is longer than the longitudinal direction length of a portion of the film which is processed in the processing solution, said processing tank is sheath-shaped and the entrance/exit port for a film is formed only at the longitudinal direction one end of said processing tank.

5. A development processing method used in a development processing apparatus which has: a plurality of stock tanks which stores a plurality of types of processing solutions; a small-volume single processing tank including an entrance/exit port for an elongated film which enables the entering/exiting of the film and which accommodates the film via the entrance/exit port for a film; processing solution supply means which supplies the plurality of types of processing solutions from said stock tanks to said processing tank; a sensor which measures the temperature of the processing solution within said processing tank; a heater which is disposed at one of said stock tanks and said processing solution supply means and heats the processing solution; and control means which connects said processing solution supply means and said heater, and said method comprising the steps of:

supplying the plurality of types of processing solutions from said stock tanks to said processing tank in a predetermined order;

developing the film in said processing tank;

controlling said processing solution supply means by said control means such that the last processing solution supplied to said processing tank is filled within said processing tank even after the film is removed from said processing tank; and controlling said heater by said control means such that the temperature of the last processing solution is set to a predetermined temperature and that said processing tank is lagged by the heated last processing solution.

6. A development processing method according to claim 5, wherein the development processing apparatus has a sealing device which closes the entrance/exit port for a film, and in a state in which the entrance/exit port for a film is closed by said sealing device, the last processing solution is circulated by said processing solution supply means.

7. A development processing method according to claim 5, wherein the development processing apparatus has conveying means which, in a state in which the longitudinal direction one end of the elongated film is engaged with a spool shaft and in which the film is taken up onto the spool shaft from the longitudinal direction one end of the film, conveys the film out of a film container accommodating the film from the longitudinal direction other end of the film and maintains a state in which the longitudinal direction one end of the film is engaged with the spool shaft, and the longitudinal direction length of said processing tank is longer than the longitudinal direction length of a portion of the film which is processed in the processing solution, said processing tank is sheath-shaped and the entrance/exit port for a film is formed only at the longitudinal direction one end of said processing tank.

8. A development processing method according to claim 6, wherein the development processing apparatus has conveying means which, in a state in which the longitudinal direction one end of the elongated film is engaged with a spool shaft and in which the film is taken up onto the spool shaft from the longitudinal direction one end of the film, conveys the film out of a film container accommodating the film from the longitudinal direction other end of the film and maintains a state in which the longitudinal direction one end of the film is engaged with the spool shaft, and the longitudinal direction length of said processing tank is longer than the longitudinal direction length of a portion of the film which is processed in the processing solution, said processing tank is sheath-shaped and the entrance/exit port for a film is formed only at the longitudinal direction one end of said processing tank.

* * * * *